US006685077B1

(12) United States Patent
Davignon et al.

(10) Patent No.: US 6,685,077 B1
(45) Date of Patent: Feb. 3, 2004

(54) DEVICE FOR DISPENSING PLASTIC FASTENERS

(75) Inventors: Paul A. Davignon, Uxbridge, MA (US); Daniel Gilbertson, Northbridge, MA (US)

(73) Assignee: Avery Dennison Corporation, Pasadena, CA (US)

( * ) Notice: Subject to any disclaimer, the term of this patent is extended or adjusted under 35 U.S.C. 154(b) by 9 days.

(21) Appl. No.: 09/950,279

(22) Filed: Sep. 10, 2001

(51) Int. Cl.[7] ..... A43D 69/00

(52) U.S. Cl. ..... 227/67; 227/71; 227/101; 227/103

(58) Field of Search ..... 227/67, 71, 101, 227/103, 136

(56) References Cited

U.S. PATENT DOCUMENTS

| | | | | | |
|---|---|---|---|---|---|
| 4,039,078 | A | | 8/1977 | Bone | |
| 4,179,063 | A | * | 12/1979 | Russell | 227/67 |
| 4,533,076 | A | | 8/1985 | Bourque | |
| 4,553,688 | A | * | 11/1985 | Furutsu | 227/67 |
| 4,664,306 | A | * | 5/1987 | Levy | 227/67 |
| 4,681,248 | A | * | 7/1987 | Duchin | 227/73 |
| 4,988,335 | A | * | 1/1991 | Prindle et al. | 604/61 |
| 5,152,445 | A | * | 10/1992 | Furutsu | 227/67 |
| 5,467,930 | A | * | 11/1995 | Lefevre | 241/84 |
| 5,472,131 | A | * | 12/1995 | Kubota | 227/67 |
| 5,482,196 | A | * | 1/1996 | Doyel | 227/67 |
| 5,615,816 | A | | 4/1997 | Deschenes et al. | |
| 5,906,039 | A | * | 5/1999 | Fukami et al. | 29/566 |

* cited by examiner

*Primary Examiner*—Rinaldi I. Rada
*Assistant Examiner*—Louis Tran
(74) *Attorney, Agent, or Firm*—Kriegsman & Kriegsman

(57) ABSTRACT

A device for dispensing a plastic staple from fastener stock includes a housing, an ejection mechanism for dispensing the staple, a severing mechanism for separating the staple from the fastener stock and an indexing mechanism for advancing the fastener stock into the housing. The ejection mechanism includes a pair of needles, a pair of movable slides, a pair of ejector rods and an actuator pin extending perpendicularly between the slides. The severing mechanism includes a pivotally mounted cam having a non-linear slot which receives the actuator pin and a knife blade coupled to the cam. The indexing mechanism includes a feed slide and a rotatable feed dog for displacing the feed slide. The feed slide includes a pair of inwardly compressible spring arms which sequentially engage the fastener stock. During the ejection process, the actuator pin travels horizontally within the housing and selectively pivots the cam and the feed dog.

7 Claims, 24 Drawing Sheets

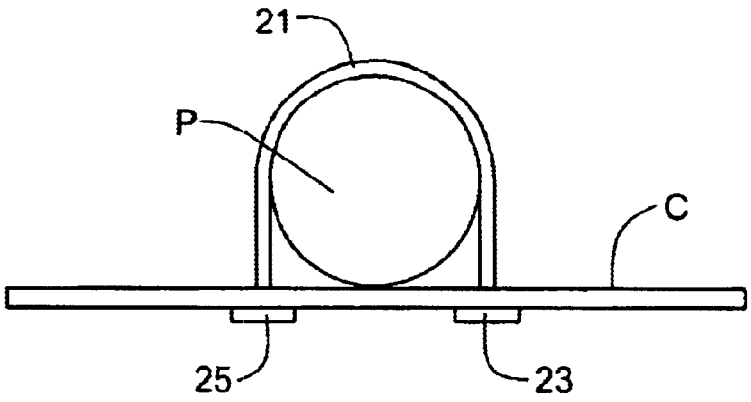
FIG. 3
FIG. 4
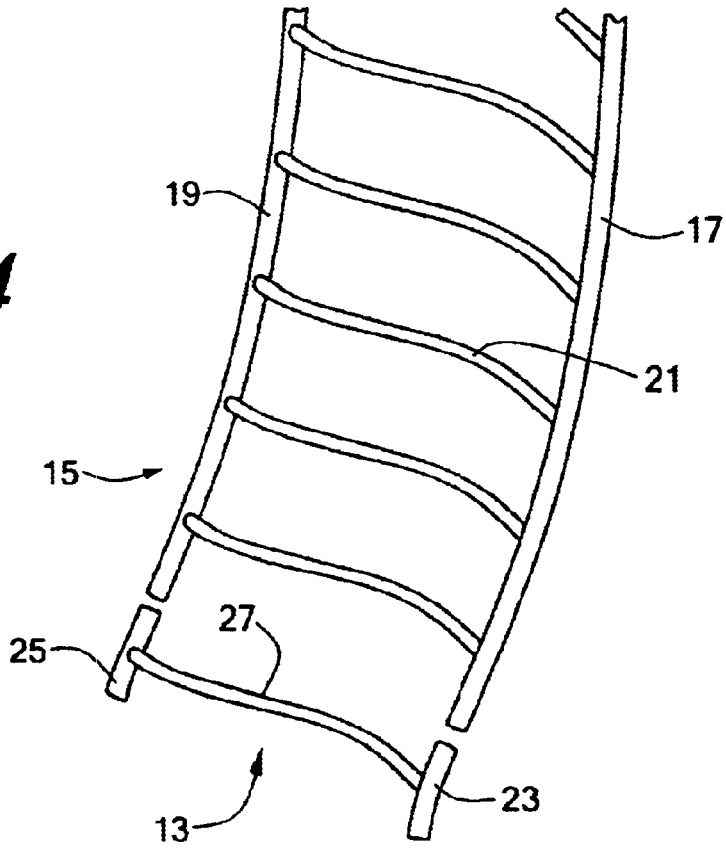

DEVICE FOR DISPENSING PLASTIC FASTENERS

BACKGROUND OF THE INVENTION

The present invention relates generally to plastic fasteners and more particularly to devices used in the dispensing of plastic fasteners.

In U.S. Pat. No. 4,039,078 to A. R. Bone, which is incorporated herein by reference, there are disclosed several different types of plastic fasteners, or attachments, which are fabricated as part of continuously connected ladder stock. In each instance, the fastener has an H-shape, and the ladder stock is formed from two elongated and continuous plastic side members coupled together by a plurality of plastic cross links, the cross links preferably being equidistantly spaced. The stock may be produced from flexible plastics material including nylon, polypropylene and other similar materials by molding or by stamping.

Either manually or with the aid of specifically designed devices, individual fasteners may be dispensed from the ladder stock to couple buttons to fabric, merchandising tags to articles of commerce, or, in general, any two desired articles. In those instances where the individual fasteners are dispensed from a device having two needles, the attachments severed from the remainder of the ladder stock can be used like staples to secure multiple items together. As a result, attachments severed from the remainder of the ladder stock which are dispensed from a device having dual needles are commonly referred to simply as plastic staples in the art.

In commonly assigned U.S. Pat. No. 5,615,816 to C. L. Deschenes et al., which is incorporated herein by reference, there is disclosed an apparatus for dispensing attachments from continuously connected ladder stock of the type comprising a pair of plastic side members coupled together by a plurality of plastic cross links. The apparatus includes a mount, a support movably mounted on the mount, and a pair of carrier blocks mounted on the support. A needle block is mounted on each carrier block and a hollow, slotted needle is mounted on each needle block. A feed mechanism including a pair of feed wheels, is mounted on the support for advancing the ladder stock into the hollow slotted needles and a pair feed tracks, one for each hollow slotted needle, are provided through which the ladder stock passes from the feed wheels into the pair of hollow slotted needles. A pair of knives are provided for severing an attachment from the ladder stock, and a pair of ejector rods are provided for ejecting the severed attachment through the hollow slotted needles. The carrier blocks are disposed parallel to each other and movable sideways relative to each other so that the spacing between the hollow slotted needles can be changed for different applications. The feed wheels are disposed parallel to each other and are capable of being moved sideways relative to each other so that their spacing can be changed to accommodate different widths of ladder stock. In order to provide a path for the ladder stock form the feed wheels to the hollow slotted needles for different feed wheel spacings and/or needle spacings, each feed track assembly includes a pivotally mounted section.

The apparatus disclosed in U.S. Pat. No. 5,615,816 to C. L. Deschenes et al. is well known and is commonly referred to in the art simply as a variable needle system (VNS). Variable needle systems of the type described in U.S. Pat. No. 5,616,816 are commonly used in the art to secure a product for sale, such as a toy, hardware item or houseware item, onto a display card using one or more staples.

Although well known and widely used in the art for dispensing plastic staples, most conventional dual needle, plastic staple dispensing devices suffer from a notable drawback. Specifically, it has been found that most conventional dual needle, plastic staple dispensing devices are considerably large in size and complex in construction. As a result, most conventional dual needle, plastic staple dispensing devices are fixedly mounted on a flat work surface, such as a bench.

As can be appreciated, there is a distinct need in the art for a dual needle, plastic staple dispensing device which can be hand-held by the operator during use.

Accordingly, in U.S. Pat. No. 4,533,076 to D. L. Bourque, there is disclosed a hand-held apparatus for dispensing attachments. During use of the hand-held apparatus disclosed in U.S. Pat. No. 4,533,076, the attachments are fed from a continuous roll of stock into position where an individual attachment is separated from the stock. Thereafter, the stock and the separated attachment are advanced so that the attachment enters a movable slide and the stock occupies the prior position of the severed attachment. The slide is then moved with respect to one or more output needles so that a plunger may force the attachment from the slide through the needles and dispense it into the material with which the attachment is being used.

The hand-held apparatus for dispensing plastic staples disclosed in U.S. Pat. No. 4,533,076 suffers from a couple notable drawbacks. Specifically, the hand-held apparatus for dispensing plastic staples disclosed in U.S. Pat. No. 4,533,076 is considerably complex in construction and unreliable in performance, which is highly undesirable.

SUMMARY OF THE INVENTION

It is an object of the present invention to provide a new and improved device for dispensing a plastic fastener from a reel of fastener stock to couple together two or more items.

It is another object of the present invention to provide a device as described above which includes at a pair of hollowed needles, each needle having a sharpened tip, wherein the pair of hollowed needles enable the plastic staple to pass through the items to be coupled together.

It is yet another object of the present invention to provide a device as described above which can be handheld by the operator.

It is yet still another object of the present invention to provide a device as described above which is reliable.

It is yet a further object of the present invention to provide a device as described above which has a limited number of parts, which is easy to use and which is inexpensive to manufacture.

Accordingly, as one feature of the present invention, there is provided a device for dispensing an individual plastic fastener from a supply of fastener stock to couple together two or more objects, the individual plastic fastener comprising a flexible filament and a transversely disposed crossbar at one end, said device comprising a housing, an ejection mechanism for dispensing the individual plastic fastener, a severing mechanism for separating the individual plastic fastener from the remainder of the supply of fastener stock, and an indexing mechanism for advancing the supply of fastener stock into said housing, said indexing mechanism comprising, a feed slide adapted to engage and advance the supply of fastener stock, and a pivotally mounted feed dog for selectively contacting and urging said feed slide.

As another feature of the present invention, there is provided a device for dispensing an individual plastic fastener from a supply of fastener stock to couple together two or more objects, the individual plastic fastener comprising a flexible filament and a transversely disposed cross-bar at one end, said device comprising a housing, an ejection mechanism for dispensing the individual plastic fastener, a severing mechanism for separating the individual plastic fastener from the remainder of the supply of fastener stock, and an indexing mechanism for advancing the supply of fastener stock into said housing, said indexing mechanism comprising, a feed slide slidably disposed within said housing, said feed slide comprising a spring arm which is adapted to selectively engage and advance the supply of fastener stock, and a pivotally mounted feed dog for displacing said feed slide.

As another feature of the present invention, there is provided device for dispensing an individual plastic fastener from a supply of fastener stock to couple together two or more objects, the individual plastic fastener comprising a flexible filament and a transversely disposed cross-bar at one end, said device comprising a housing, said housing being shaped to define a ejector rod slide guide channel, an ejection mechanism for dispensing the individual plastic fastener, said ejection mechanism comprising, a hollow needle having a sharpened tip and an elongated bore, an ejector rod slide adapted for lateral displacement within the ejector rod slide guide channel in said housing, an ejector rod mounted onto said ejector rod slide, said ejector rod being adapted to selectively protrude into the elongated bore of said hollow needle to eject the cross-bar of the individual plastic fastener out through said hollow needle, and an actuator pin fixedly mounted onto said ejector rod slide, a severing mechanism for separating the individual plastic fastener from the remainder of the supply of fastener stock, and an indexing mechanism for advancing the cross-bar of the individual plastic fastener into alignment with the elongated bore of the hollow needle.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts:

FIG. 3 is a front plan view of a product for sale secured onto a display card using a plastic staple dispensed from the device shown in FIG. 1;

FIG. 4 is a perspective view of a length of continuously connected ladder stock which may be used with the device shown in FIG. 1;

DETAILED DESCRIPTION OF THE PREFERRED EMBODIMENT

Figure 1:
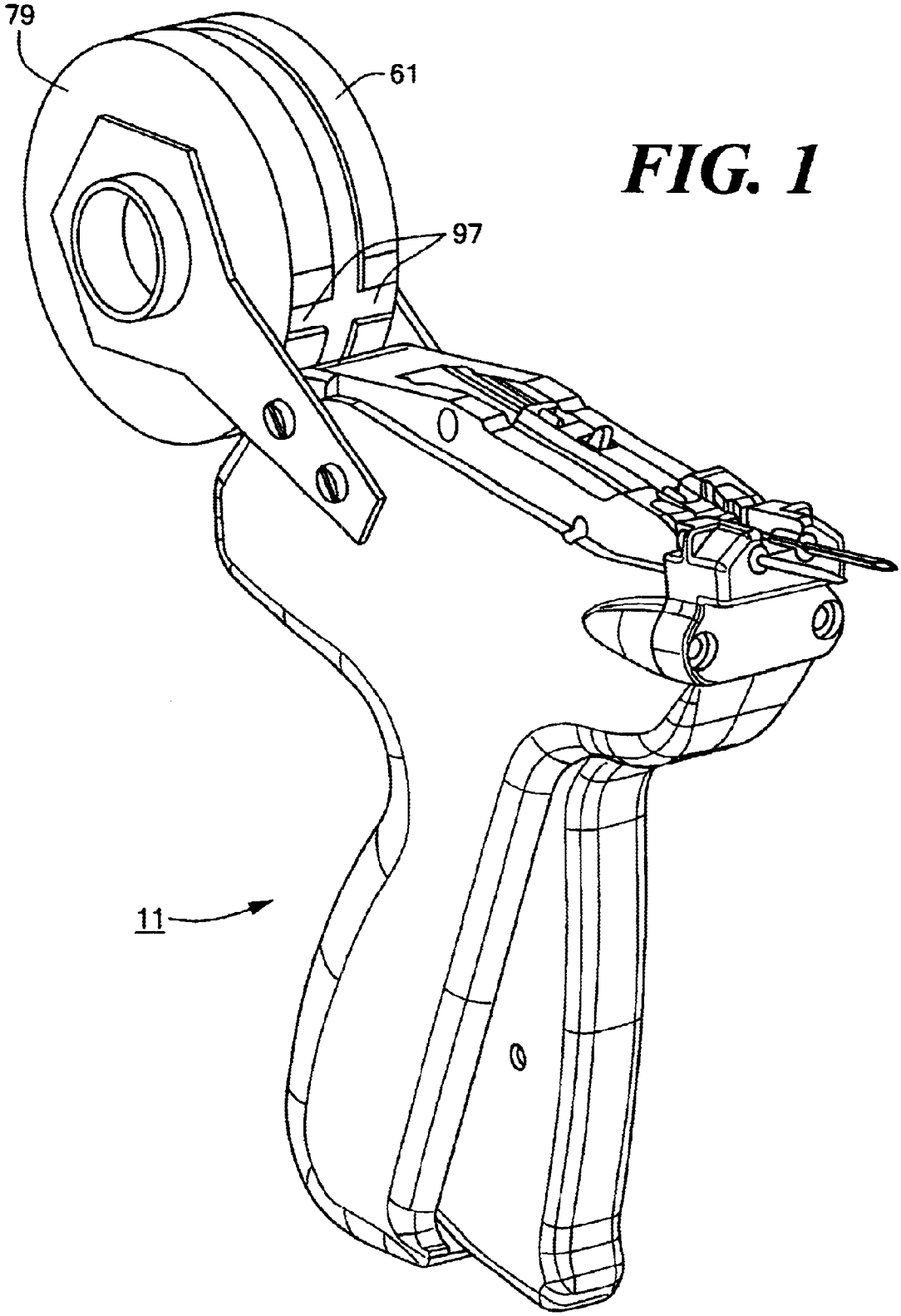
FIG. 1 is a right side perspective view of a device constructed according to the teachings of the present invention for dispensing plastic staples from a supply of continuously connected ladder stock.
Figure 2:
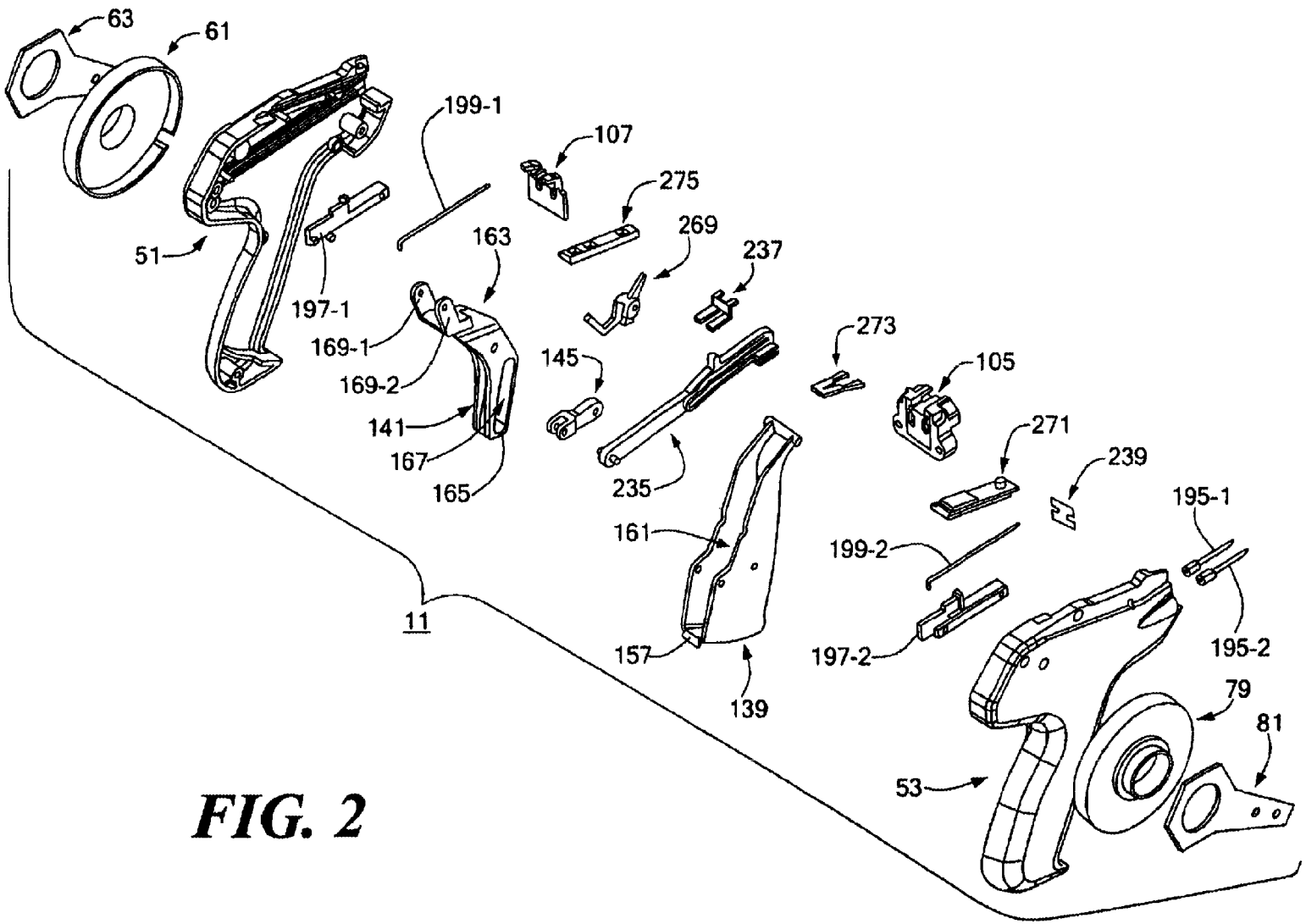
FIG. 2 is an exploded perspective view of the device shown in FIG. 1, the device being shown with selected components of the trigger assembly and the actuator pin removed therefrom.

Referring now to FIGS. 1–2, there is shown a device constructed according to the teachings of the present invention, the device being identified generally by reference numeral 11. As will be described further in detail below, device 11 is designed for use in dispensing individual plastic staples 13 from a supply of continuously connected ladder stock 15 to secure two or more items together. Specifically, device 11 may be used, for example, to secure a product P for sale, such as a toy, hardware item or houseware item, onto to a cardboard display card C using one or more plastic fasteners, as shown in FIG. 3.

Continuous Supply of Ladder Stock 15

Supply of continuously connected ladder stock 15 represents any well known continuous supply of plastic fastener stock which includes a pair of side members interconnected by a plurality of cross-links. For example, ladder stock 15 may be of the type described in U.S Pat. No. 4,039,078 to A. R. Bone.

FIG. 4 shows a perspective view of a prior art length of continuously connected ladder stock 15 with which the system of this invention may be used. Ladder stock 15 is preferably made of a plastic material, such as polypropylene or nylon, and comprises a pair of side members 17 and 19 which are interconnected by a plurality of cross-links 21. An individual plastic staple, or fastener, 13 which is obtained from ladder stock 15 is similarly shown in FIG. 4. Plastic staple 13 comprises a pair of cross-bars 23 and 25 which are interconnected by a filament 27, cross-bars 23 and 25 comprising sections of side members 17 and 19, respectively, and filament 27 comprising a cross-link 21.

It should be noted that, for simplicity purposes only, device 11 will be described for use with ladder stock 15. However, it is to be understood that device 11 could be described for use with alternative types of ladder stock without departing from the spirit of the present invention.

Device 11 for Dispensing Plastic Staples 13

Device 11 comprises a housing 29, a trigger assembly 31 for actuating device 11, an ejection mechanism 33 for dispensing a desired plastic staple 13 from device 11 to secure together two or more items, a severing mechanism 35 for separating the desired plastic staple 13 to be dispensed by ejection mechanism 33 from the remainder of ladder stock 15, and an indexing mechanism 37 for feeding the desired plastic staple 13 into proper alignment within housing 29 prior to the severing and ejection processes. It should be noted that portions of device 11 not pertinent to this invention are neither shown nor described in detail herein.

Housing 29 for Device 11

Figure 5:
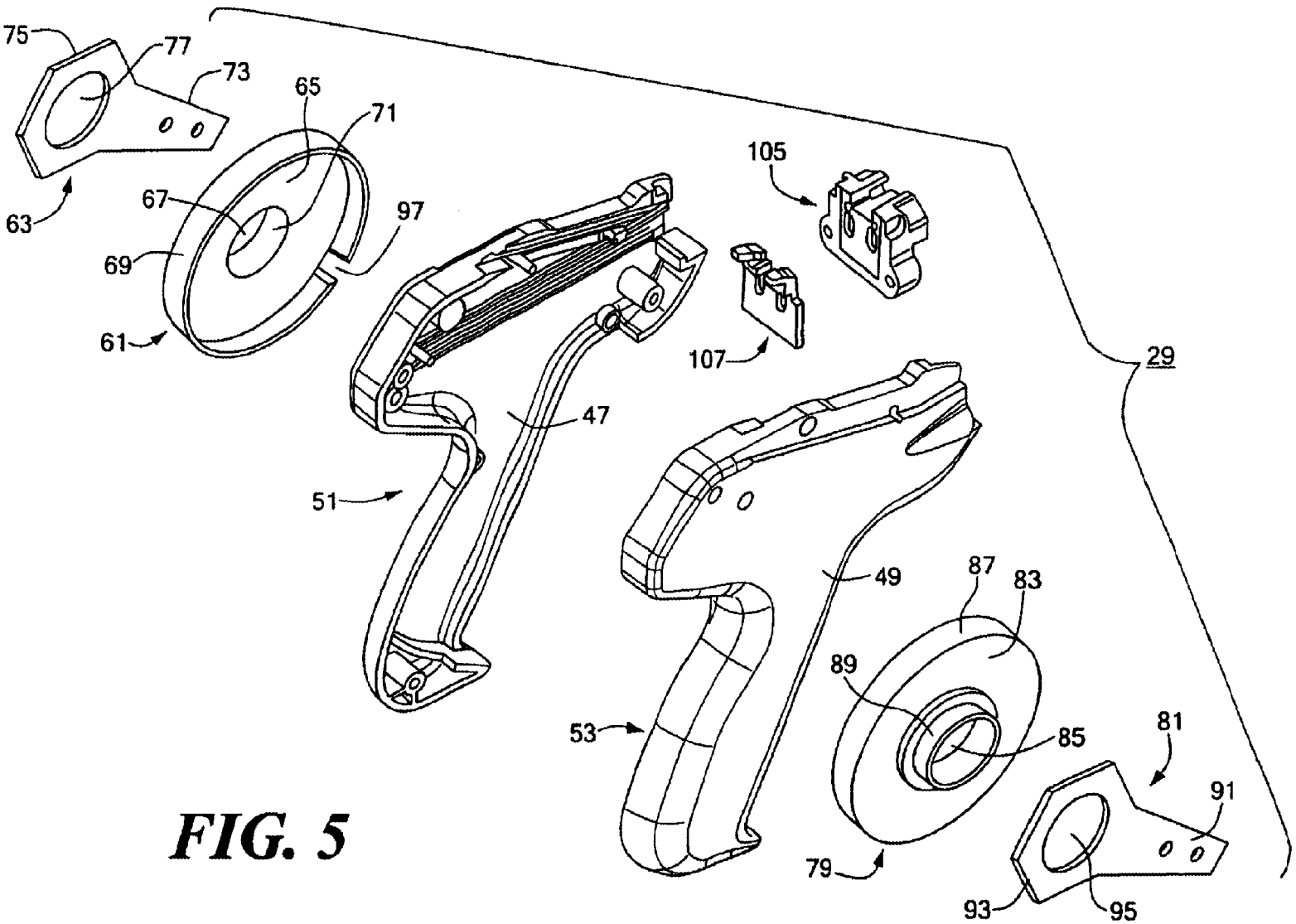
FIG. 5 is an exploded perspective view of the housing for the device shown in FIG. 1.
Figure 6:
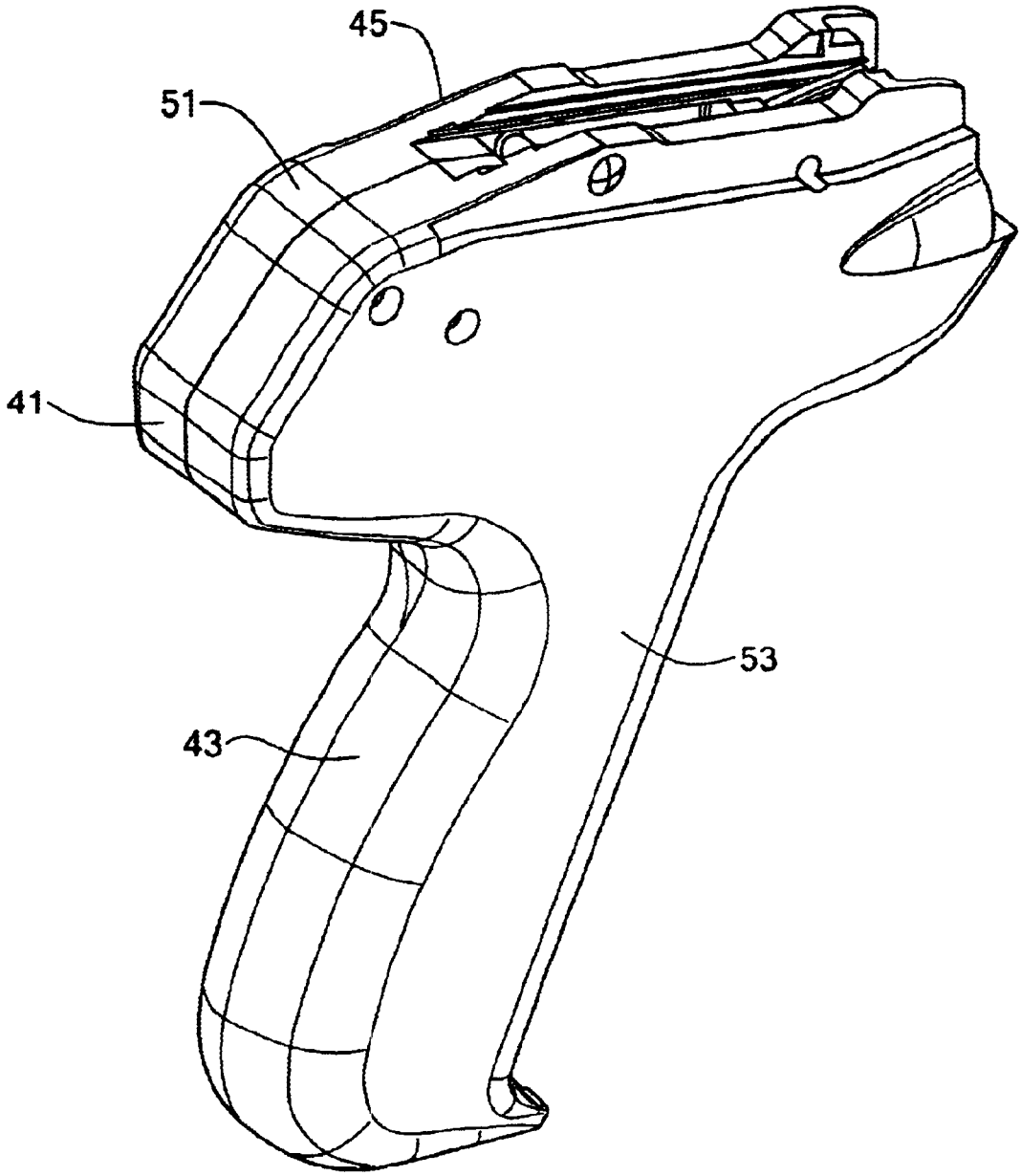
FIG. 6 is a right side perspective view of the left and right side pieces of the housing for the device shown in FIG. 1.
Figure 7:
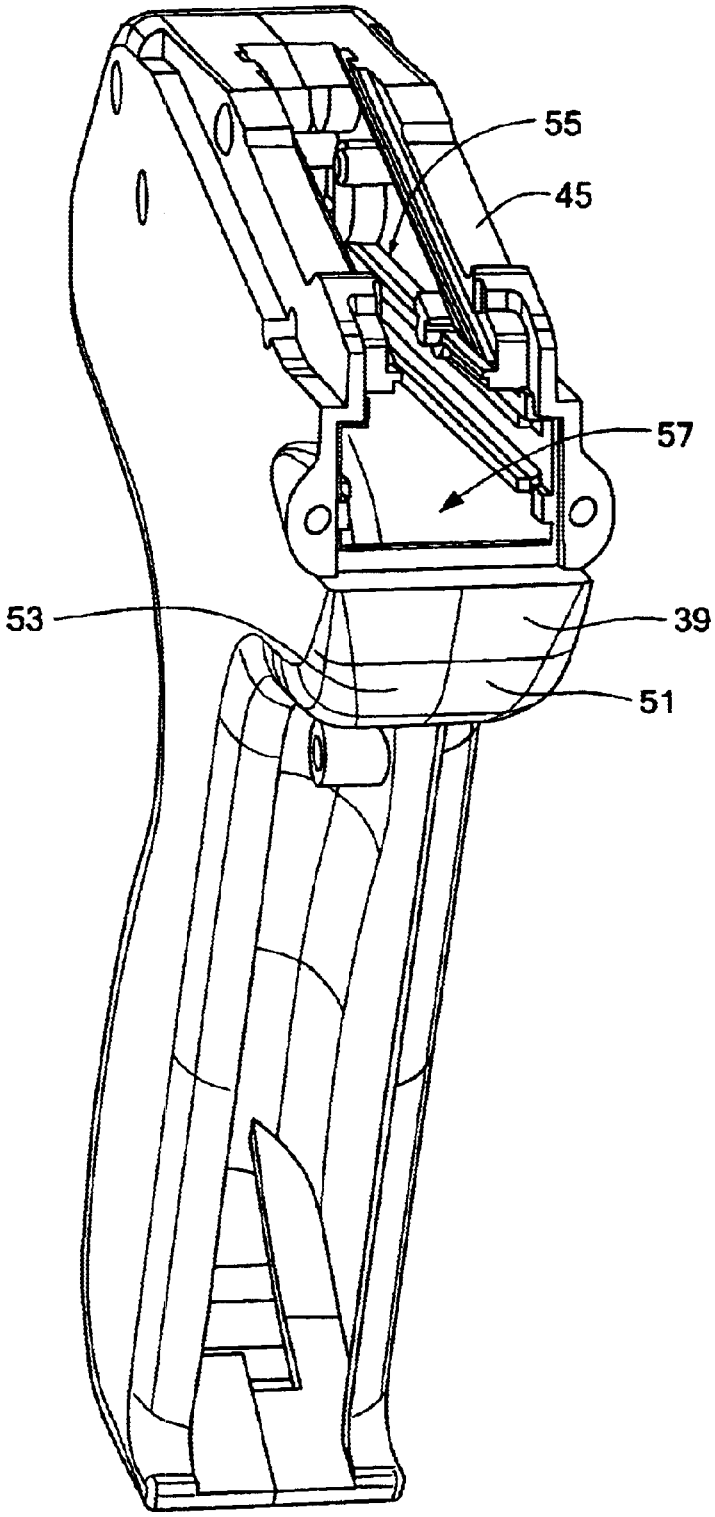
FIG. 7 is a front perspective view of the left and right side pieces of the housing for the device shown in FIG. 1.
Figure 8:
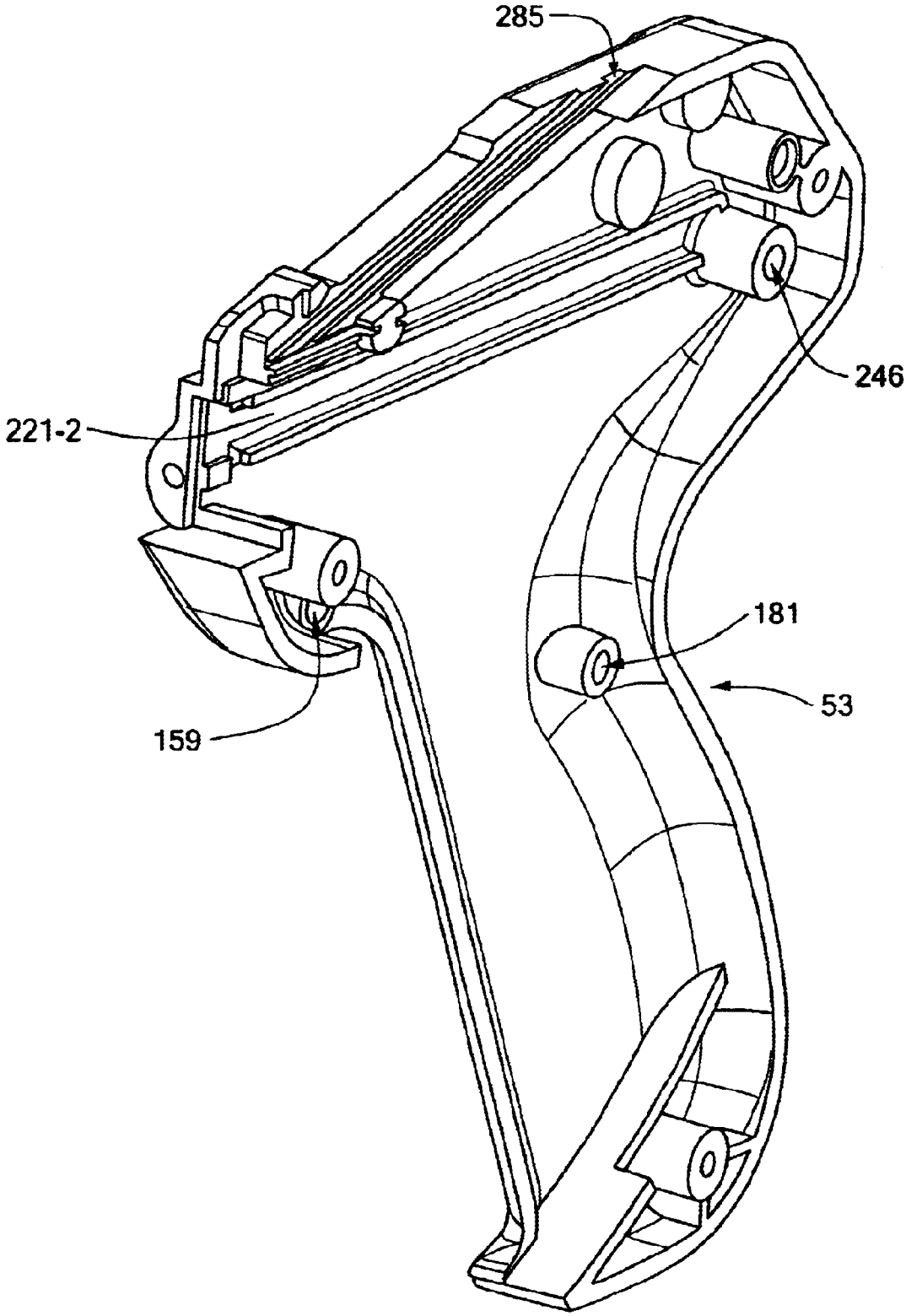
FIG. 8 is a left side perspective view of the right side piece of the housing for the device shown in FIG. 1.
Figure 9:
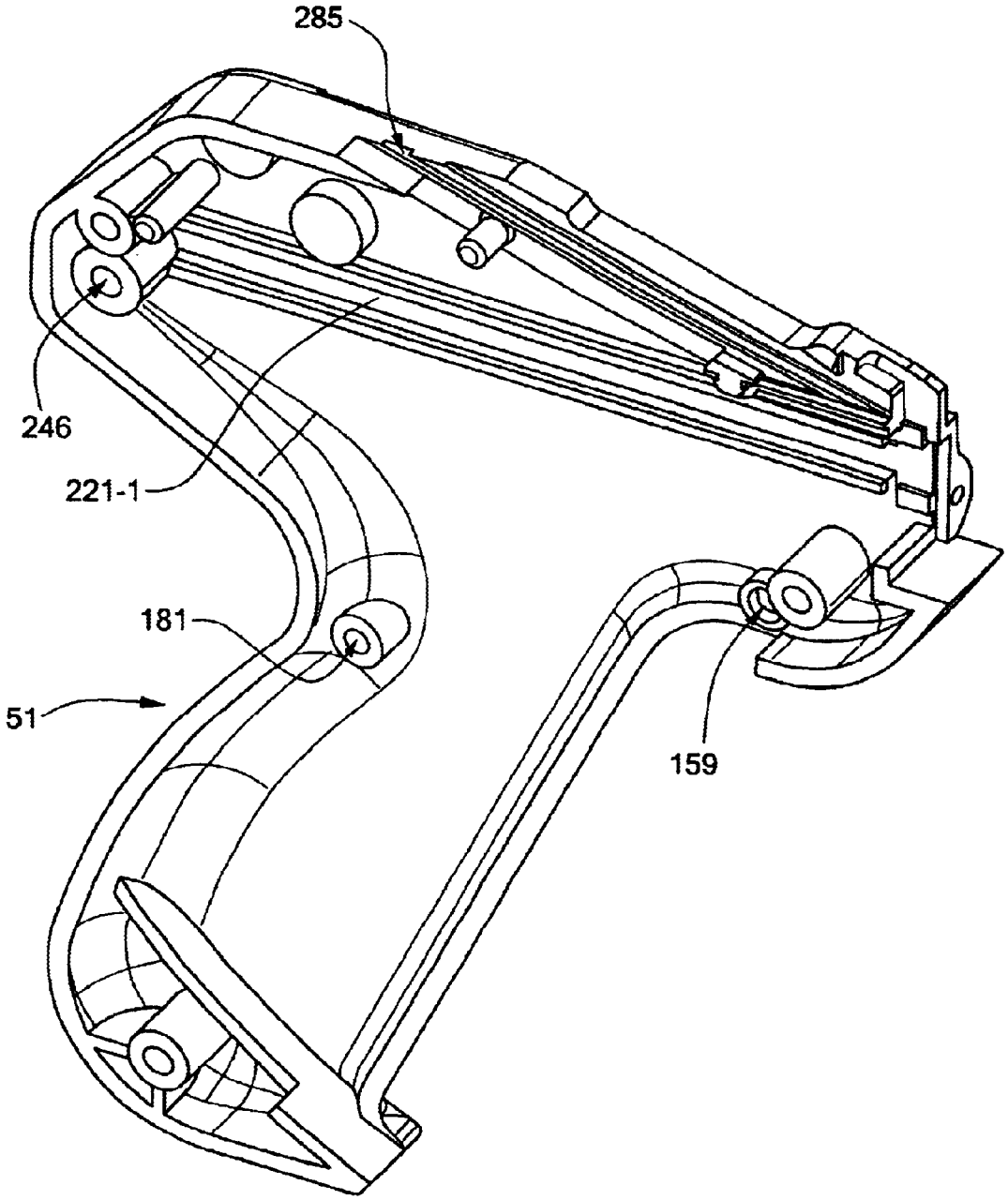
FIG. 9 is a right side perspective view of the left side piece of the housing for the device shown in FIG. 1.

Referring now to FIGS. 5–7, housing 29 is in the shape of a hollow gun and includes a front end 39, a rear end 41, a handle 43, a top surface 45, an inner surface 47 and an outer surface 49. Housing 29 is preferably constructed of a rigid and durable material such as polycarbonate.

Housing 29 includes a left side piece 51 and a right side piece 53 which are affixed together by a plurality of screws (not shown). It should be noted that left side piece 51 and right side piece 53 are not limited to being affixed together by screws. Rather, it is to be understood that left side piece 51 and right side piece 53 may be joined together by alternative means, such as through a snap-fit, sonic welding, gluing, riveting or the like, without departing from the spirit of the present invention.

Affixed together, left side piece 51 and right side piece 53 are shaped to define an elongated slot 55 in top surface 45 of housing 29 a rectangular opening 57 in front end 39 of housing 29, Housing also includes a cannister for holding a roll of ladder stock 15.

The cannister comprises a left cannister piece 61 which is affixed onto outer surface 49 of left side piece 51 by an extension arm 63. Specifically, left cannister piece 61 is an integral piece which includes a flat annular member 65 having a central bore 67, a sidewall 69 which is formed onto and extends perpendicularly in from the outer periphery of annular member 65 and a cylindrical boss 71 which is formed onto and extends perpendicularly out from annular member 65 around central bore 67. Extension arm 63 is a flat member which includes a first end 73 which is adapted to be secured onto outer surface 49 of left side piece 51 by screws (not shown) and a second end 75 which is shaped to define a central opening 77 which is sized and shaped to fittingly receive cylindrical boss 71.

The cannister also comprises a right cannister piece 79 which is affixed onto outer surface 49 of right side piece 53 by an extension arm 81. Specifically, right cannister piece 79 is an integral piece which includes a flat annular member 83 having a central bore 85, a sidewall 87 which is formed onto and extends perpendicularly in from the outer periphery of annular member 83 and a cylindrical boss 89 which is formed onto and extends perpendicularly out from annular member 83 around central bore 85. Extension arm 81 is a flat member which includes a first end 91 which is adapted to be secured onto outer surface 49 of right side piece 53 by screws (not shown) and a second end 93 which is shaped to define a central opening 95 which is sized and shaped to fittingly receive cylindrical boss 89.

As can be appreciated, the cannister is constructed to hold a supply of spirally wound ladder stock 15 between left cannister piece 61 and right cannister piece 79. Left cannister piece 61 and right cannister piece 79 are each shaped to define a narrow slot 97 through which the supply of spirally wound ladder stock 15 can exit.

It should be noted that a narrow fastener passageway is preferably formed into each of left side piece 51 and right side piece 53 of housing 29. Accordingly, with left side piece 51 and right side piece 53 affixed together, the narrow fastener passageways together define a fastener track which is sized and shaped to receive the supply of ladder stock 15 exiting the cannister and to guide the supply of ladder stock 15 into position within housing 29 for the subsequent severing and ejection processes, which will be described further in detail below.

Housing 29 further includes a needle housing assembly 103 removably mounted onto left side piece 51 and right side piece 53 by a pair of screws (not shown), needle housing assembly 103 being mounted onto left side piece 51 and right side piece 53 so as to enclose rectangular opening 57 in front end 39 of housing 29.

Figure 10:
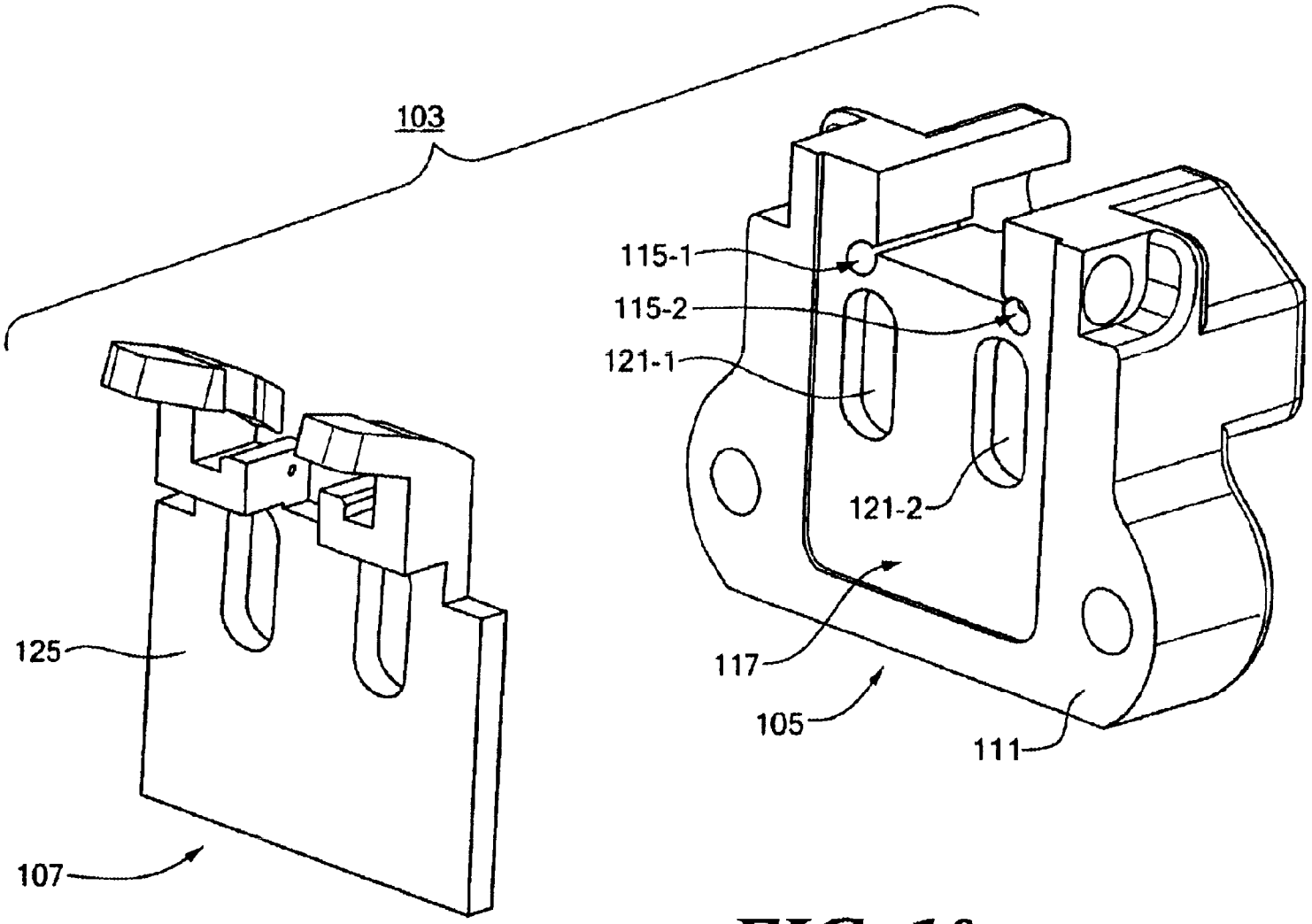
FIG. 10 is a rear, exploded perspective view of needle housing for the device shown in FIG. 1.
Figure 11:
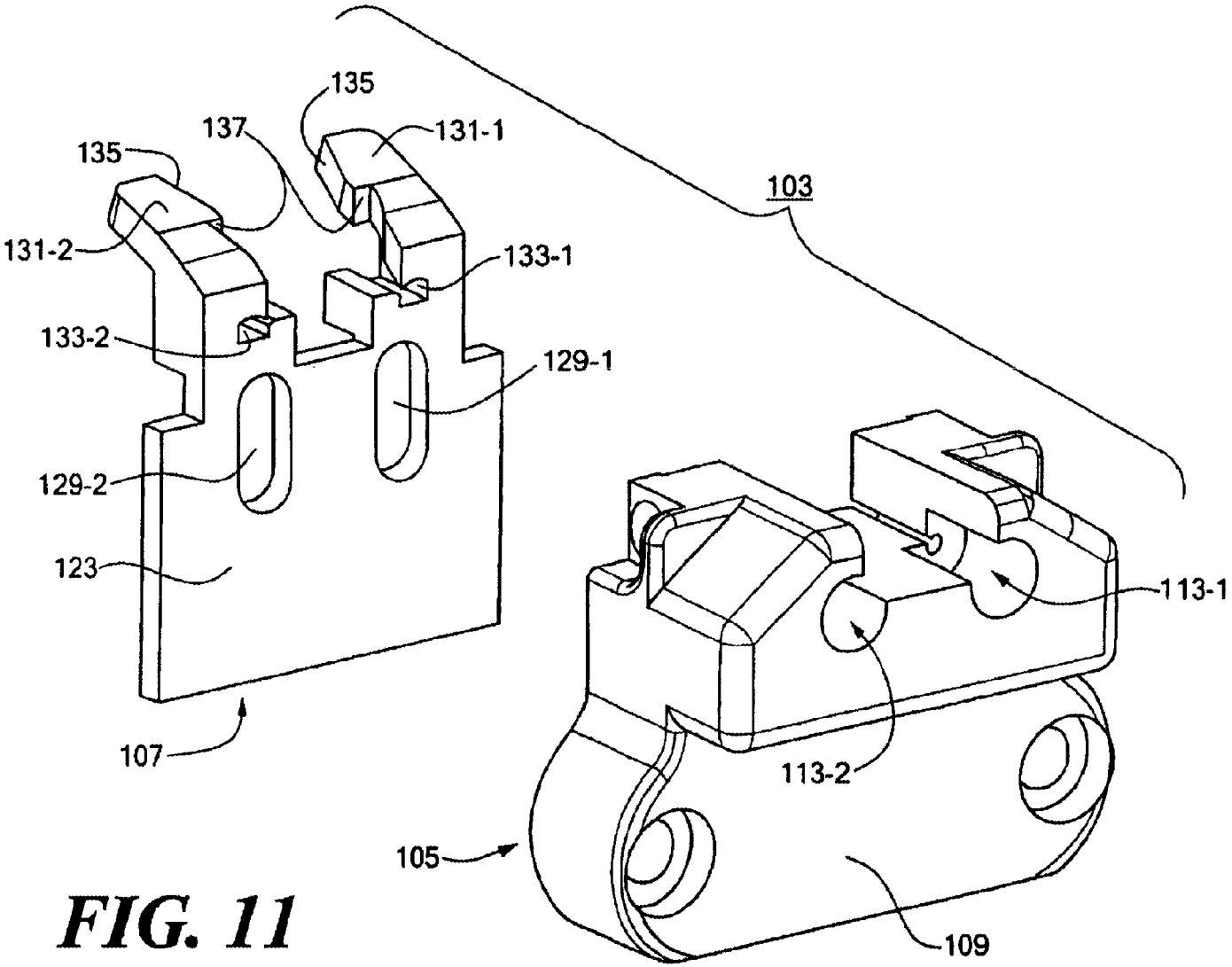
FIG. 11 is a front,.exploded perspective view of the needle housing for the device shown in FIG. 1.

As seen most clearly in FIGS. 10–11, needle housing assembly 103 comprises a needle housing 105 and a support plate 107.

Needle housing 105 includes a front surface 109 and a rear surface 111. Front surface 109 of needle housing 105 is shaped to define a pair of spaced apart needle receptacles 113-1 and 113-2. A pair of tapered guide channels 115-1 and 115-2 extend in from rear surface 111 and into communication with needle receptacles 113-1 and 113-2, respectively. As such, each cross-bar of an individual plastic staple 13 is capable of traveling longitudinally through an associated tapered guide channels 115 and into an associated needle disposed within needle receptacle 113.

Rear surface 111 of needle housing 105 is slightly recessed so as to form a shallow channel 117 into which a knife blade is capable of being slidably disposed, as will be described further below. Rear surface 111 further includes a pair of spaced apart grooves 121-1 and 121-2.

Support plate 107 is a substantially flat member which includes a flat front surface 123 and a rear surface 125. A pair of spaced apart, vertically disposed, slots 129-1 and 129-2, respectively, are formed in support plate 107. As such, a pair of prongs can extend through slots 129 in support plate 107, through corresponding slots formed in a knife blade, and into spaced apart grooves 121 in needle housing 105. In this manner, the pair of fingers can be vertically displaced within needle housing assembly 103 to slide the knife blade up and down, as will be described further in detail below in conjunction with severing mechanism 35.

Support plate 107 further includes a pair spaced apart, rearwardly displaced tabs 131-1 and 131-2 which define a pair of tapered guide channels 133-1 and 133-2. With support plate 107 mounted onto needle housing 105, tapered guide channels 133-1 and 133-2 are disposed in communication with tapered guide channels 115-1 and 115-2, respectively, in needle housing 105. It should be noted that each of tabs 131 is shaped to include a inwardly beveled sidewall 135 and a stop 137. As can be appreciated, during operation of device 11, stops 137 are sequentially positioned behind an individual cross-link 21 of ladder stock 15 to preclude the inadvertent rearward advancement of ladder stock 15 through device 11.

It should be noted that needle housing 105 is removably mounted onto left side piece 51 and right side piece 53 by a pair of screws in such a manner so as to releasably couple needle housing 105 and support plate 107 together.

Trigger Assembly 31 for Device 11

Trigger assembly 31 serves to activate ejection mechanism 33 which, in turn, activates severing mechanism 35 and indexing mechanism 37, as will be described further in detail below.

Figure 12:
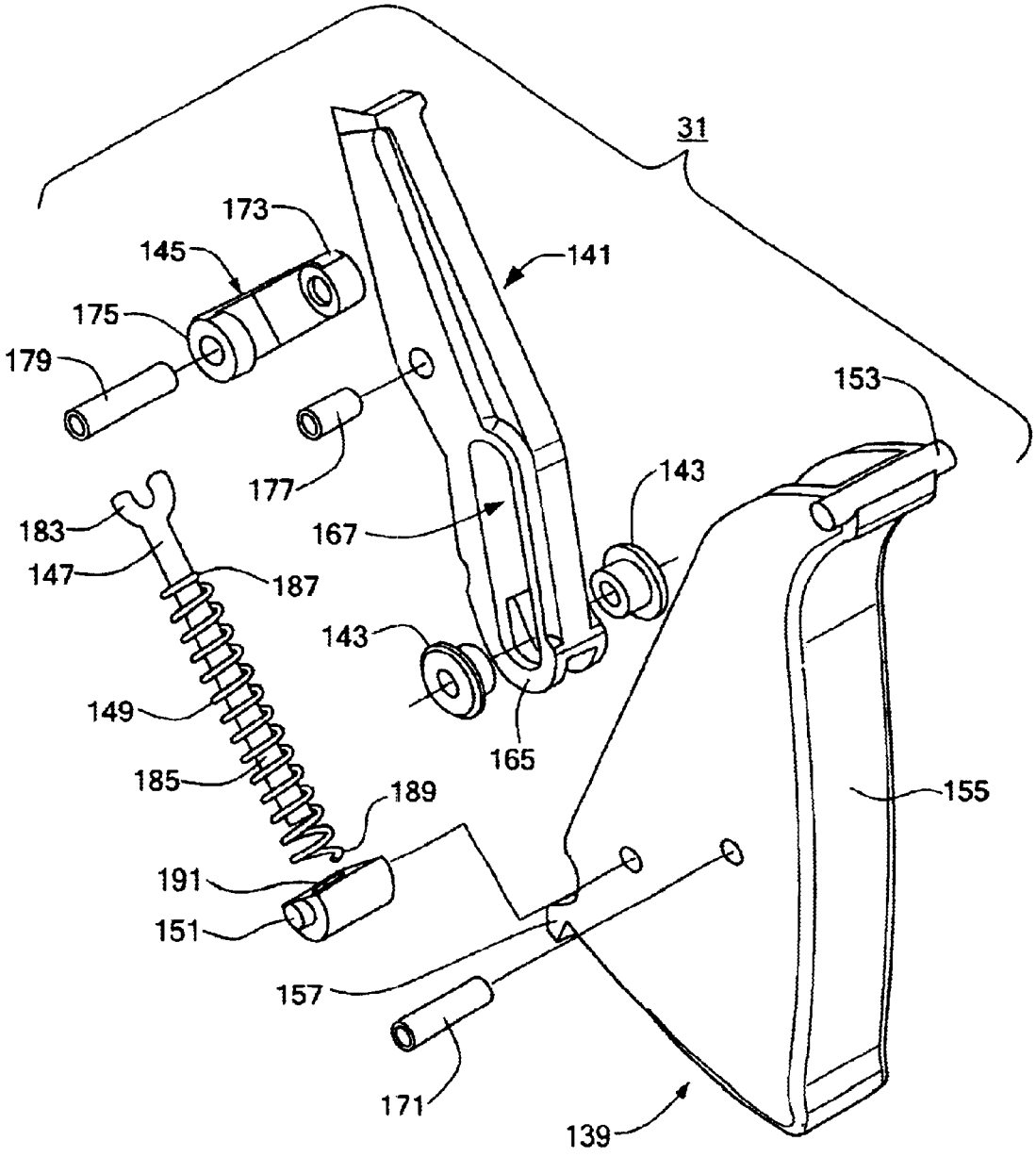
FIG. 12 is an exploded, fragmentary, perspective view of the trigger assembly for the device shown in FIG. 1.

Referring now to FIGS. 2 and 12, trigger assembly 31 comprises a trigger 139, a drive link 141, a pair of rollers 143, an idler link 145, a spring retainer 147, a compression spring 149 and a spring pivot 151. Trigger assembly 31 differs principally in construction from the conventional trigger assembly described in U.S. Pat. No. 4,456,123 to Russell in the construction of drive link 141, as will be described further in detail below.

Trigger 139 includes an integrally formed post 153, an elongated ergonomically-shaped, finger actuation surface 155 and a foot 157. Post 153 is sized and shaped to be fittingly disposed within a trigger post receptacle 159 which is integrally formed in each of left side piece 51 and right side piece 53. Actuation surface 155 is elongated and ergonomically-shaped to conform with the shape of the fingers of the user. Trigger 139 is hollowed so as to define a trigger cavity 161 therewithin.

As seen most clearly in FIG. 2, drive link 141 includes a bifurcated first end 163, a second end 165 and an elongated slot 167 formed at second end 165. The construction of first end 163 of drive link 141 is the principal difference between trigger assembly 31 and the trigger assembly described in U.S. Pat. No. 4,456,123 to Russell. Specifically, first end 163 is bifurcated to include a first prong 169-1 and a second prong 169-2, prongs 169 being spaced apart and pivotally connected to ejection mechanism 33.

As seen most clearly in FIG. 12, pair of rollers 143 are fixedly mounted onto trigger 139 within trigger cavity 161 about a dowel pin 171 and are disposed to project within slot 167 formed in drive link 141. Positioned as such, rollers 143 are capable of rotatably traveling within slot 167 in drive link 141.

Idler link 145 is a substantially straight member which includes a first end 173 and a second end 175. First end 173 of idler link 145 is fixedly mounted onto the approximate midpoint of drive link 141 about a dowel pin 177. In addition, a dowel pin 179 is fixedly mounted onto second end 175 of idler link 145 and is sized and shaped to be fittingly disposed within idler link receptacles 181 formed into housing 29, thereby enabling drive link 141 to pivot about dowel pin 179.

Spring retainer 147 is an elongated member which is generally circular in lateral cross-section and includes a first end 183 which is adapted to snap engage onto dowel pin 179 and a second end 185. Compression spring 149 is sized and shaped to be slidably mounted onto spring retainer 147 and includes a first end 187 and a second end 189. Spring pivot 151 is pivotally mounted onto trigger 139 and is disposed within trigger cavity 161. As such, spring retainer 147 is disposed such that first end 183 is snap mounted onto dowel pin 179 and second end 185 is disposed through a circular opening 191 formed in spring pivot 151. With spring retainer 147 positioned in this manner, first end 187 of compression spring 149 contacts first end 183 of spring retainer 147 and second end 189 of compression spring 149 contacts spring pivot 191, thereby causing compression spring 149 to resiliently urge trigger 139 outward until foot 157 on trigger 139 abuts against a trigger stop 193 integrally formed into housing 29.

In use, trigger assembly 31 functions in the following manner. Specifically, trigger 139 is resiliently urged by trigger compression spring 149 outward until foot 157 on trigger 139 abuts against trigger stop 193 formed in housing 29. Upon the application of an inward force onto actuation surface 155, trigger 139 pivots about post 153 which, in turn, causes rollers 143 to apply an inward force onto drive link 141 as rollers 143 slide upward within slot 167. The inward force applied to second end 165 of drive link 141 causes drive link 141 to pivot in a counterclockwise direction about dowel pin 179. Upon release of the inward force, trigger compression spring 149 resiliently urges trigger 139 outward until foot 157 on trigger 139 abuts against trigger stop 193, thereby returning trigger assembly 31 to its original position.

Ejection Mechanism 33 for System 11

Figure 13:
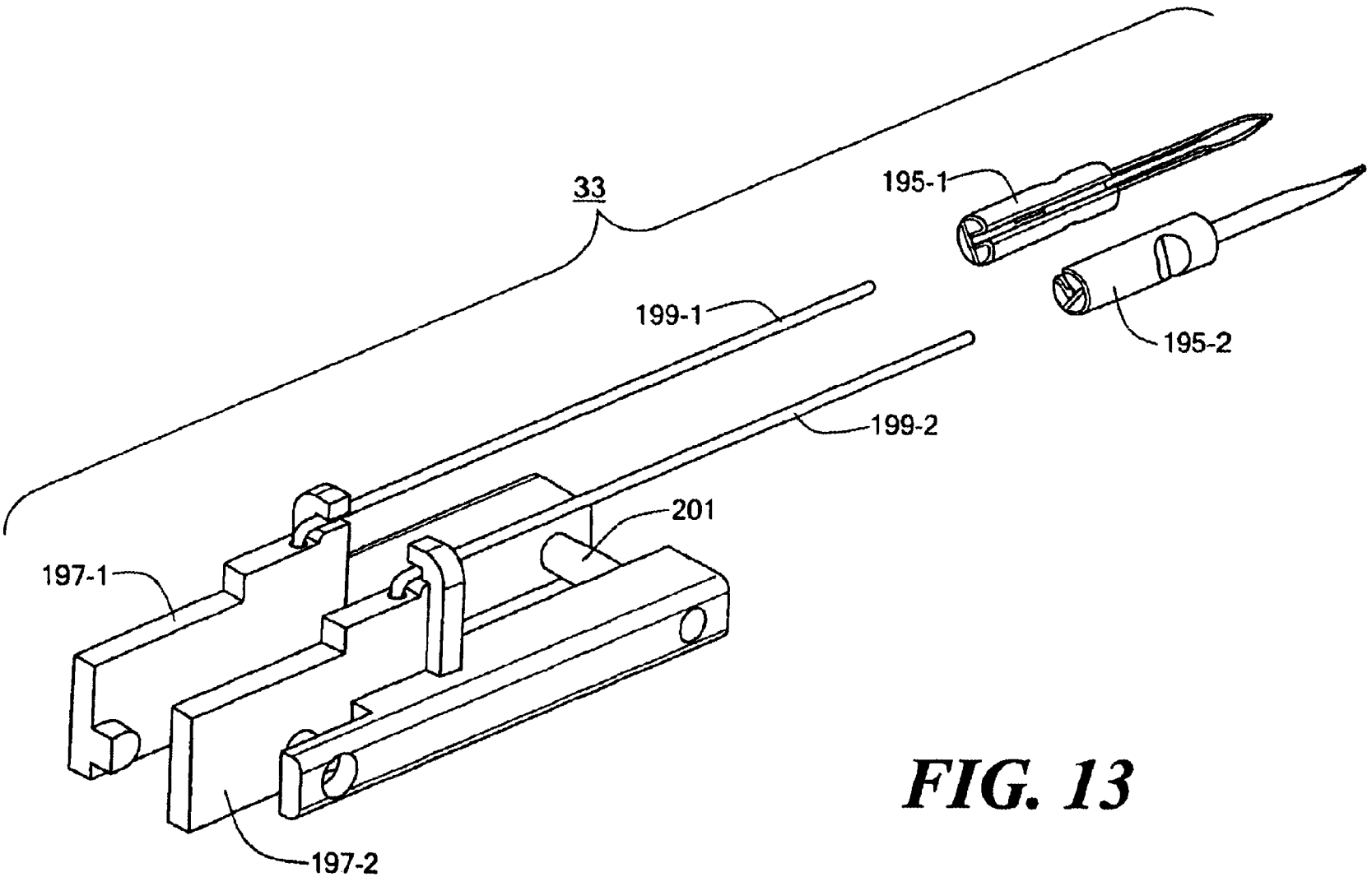
FIG. 13 is a perspective view of the ejection mechanism for the device shown in FIG. 1.
Figure 14:
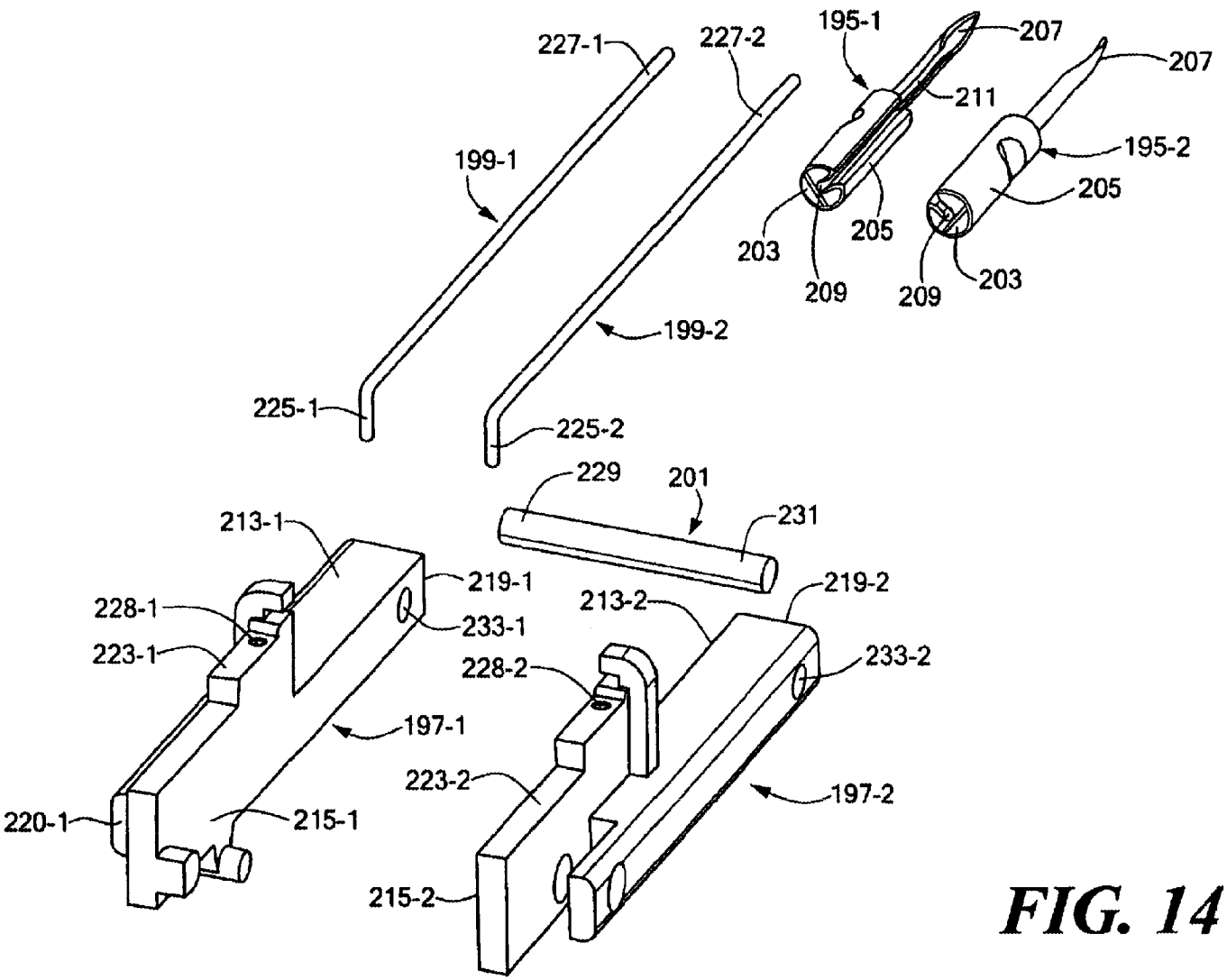
FIG. 14 is an exploded perspective view of the ejection mechanism for the device shown in FIG. 1.

Referring now to FIGS. 13–14, ejection assembly 33 serves to dispense an individual plastic staple 13 from device 11 to secure together two or more items. Ejection assembly 33 comprises a pair of hollowed needles 195-1 and 195-2 removably disposed within needle receptacles 113-1 and 113-2, respectively, in needle housing 103, a pair of ejector rod slides 197-1 and 197-2 which are capable of lateral displacement within housing 29, a pair of ejector rods 199-1 and 199-2 fixedly mounted onto ejector rod slides 197-1 and 197-2, respectively, for urging the cross-bars of an individual plastic staple through hollowed needles 195-1 and 195-2, respectively, and an actuator pin 201 fixedly mounted onto and extending laterally between pair of ejector rod slides 197.

Hollow slotted needles 195 are of the type which are used in conventional fastener dispensing devices. Specifically, each needle 195 comprises a rear end 203 which is covered by a needle casing 205 and a forward end 207 in the form of a sharpened tip. Each needle 195 also includes an elongated bore 209 which is sized and shaped to receive an associated cross-bar for plastic staple 13. Each needle 195 further includes a slot 211 in communication with bore 209, slot 211 being sized and shaped to enable a portion of staple filament 27 to slide therethrough. It should be noted that needles 195 are spaced apart in such a manner so that, with cross-bars 23 and 25 of an individual plastic staple 13 positioned therewithin, staple filament 27 extends between needles 195 in an outwardly bowed configuration.

Ejector rod slides 197 are spaced apart and are capable of lateral displacement within housing 29 between front end 39 and rear end 41.

Left ejector rod slide 197-1 includes an elongated block 213-1 which is generally rectangular in lateral cross-section and which includes a first end 215-1 which is pivotally mounted onto prong 169-1 of drive link 141 about a pivot pin and a second end 219-1. It should be noted that elongated block 213-1 includes a guide projection 220-1 which is sized and shaped to partially extend into a guide :channel 221-1 formed in left side piece 51, guide channel 221-1 thereby limiting ejector rod slide 197-1 to lateral displacement within housing 29. A tab 223-1 extends up vertically from elongated block 213-1 and serves to support ejector rod 199-1, as will be described further in detail below.

Similarly, right ejector rod slide 197-2 includes an elongated block 213-2 which is generally rectangular in lateral cross-section and which includes a first end 215-2 which is pivotally mounted onto prong 169-2 of drive link 141 about a pivot pin and a second end 219-2. It should be noted that elongated block 213-2 is sized and shaped to partially extend into a guide channel 221-2 formed in right side piece 53, guide channel 221-2 thereby limiting ejector rod slide 197-2 to lateral displacement within housing 29. A tab 223-2 extends up vertically from elongated block 213-2 and serves to support ejector rod 199-2, as will be described further in detail below.

Ejector rod 199-1 is an elongated cylindrical member which comprises a first end 225-1 and a second end 227-1. Ejector rod 199-1 is sized and shaped so that first end 225-1 can be removably disposed into a hole 228-1 formed into tab 223-1 of left ejector rod slide 197-1. Ejector rod 199-1 is configured such that, with first end 225-1 fittingly disposed within hole 228-1 formed in tab 223-1, second end 227-1 extends horizontally through device 11 towards front end 39 of housing 29. As can be appreciated, as left ejector rod slide 197-1 advances laterally forward towards front end 39 of housing 29, ejector rod 199-1 eventually protrudes into bore 209 of hollowed needle 195-1 so as to urge cross-bar 23 of an individual plastic staple 13 out through sharpened tip of needle 195-1.

Similarly, ejector rod 199-2 is an elongated cylindrical member which comprises a first end 225-2 and a second end 227-2. Ejector rod 199-2 is sized and shaped so that first end 225-2 can be removably disposed into a hole 228-2 formed into tab 223-2 of right ejector rod slide 197-2. Ejector rod 199-2 is configured such that, with first end 225-2 fittingly disposed within hole 228-2 formed in tab 223-2, second end 227-2 extends horizontally through device 11 towards front end 39 of housing 29. As can be appreciated, as right ejector rod slide 197-2 advances laterally forward towards front end 39 of housing 29, ejector rod 199-2 eventually protrudes into bore 209 of hollowed needle 195-2 so as to urge cross-bar 23 of an individual plastic staple 13 out through sharpened tip of needle 195-2.

Actuator pin 201 serves to actuate severing mechanism 35 and indexing mechanism 37 as ejector rod slides 197 advance laterally forward, as will be described further in detail below. Actuator pin 201 is in the form of a cylindrical post having a first end 229 and a second end 231. First end 229 of actuator pin 201 is sized and shaped to fittingly protrude through a circular hole 233-1 formed in second end 219-1 of left ejector rod slide 197-1. Similarly, second end 231 of actuator pin 201 is sized and shaped to fittingly protrude through a circular hole 233-2 formed in second end 219-2 of right ejector rod slide 197-2. As such, actuator pin 201 extends perpendicularly between ejector rod slides 197.

In use, ejection mechanism 33 functions in the following manner to dispense an individual plastic staple 13 from device 11. With indexing mechanism 37 having positioned cross-bars 23 and 25 of an individual plastic staple 13 into alignment within elongated bores 209 of needles 195 and with severing mechanism 35 separating the individual plastic staple 13 from the remainder of ladder stock 15, actuation of trigger assembly 31 commences the ejection process. Specifically, the actuation of trigger assembly 31 drives ejector rod slides 197 forward which, in turn, advances ejector rods 199 into bores 209 of hollowed needles 195. As ejector rods 199 project into bores 209 of needles 195, ejector rods 199 contact and advance cross-bars 23 and 25 of plastic staple 13 out through needles 195, thereby dispensing staple 13 into the desired objects.

Severing Mechanism 35 for Device 11

Figure 15:
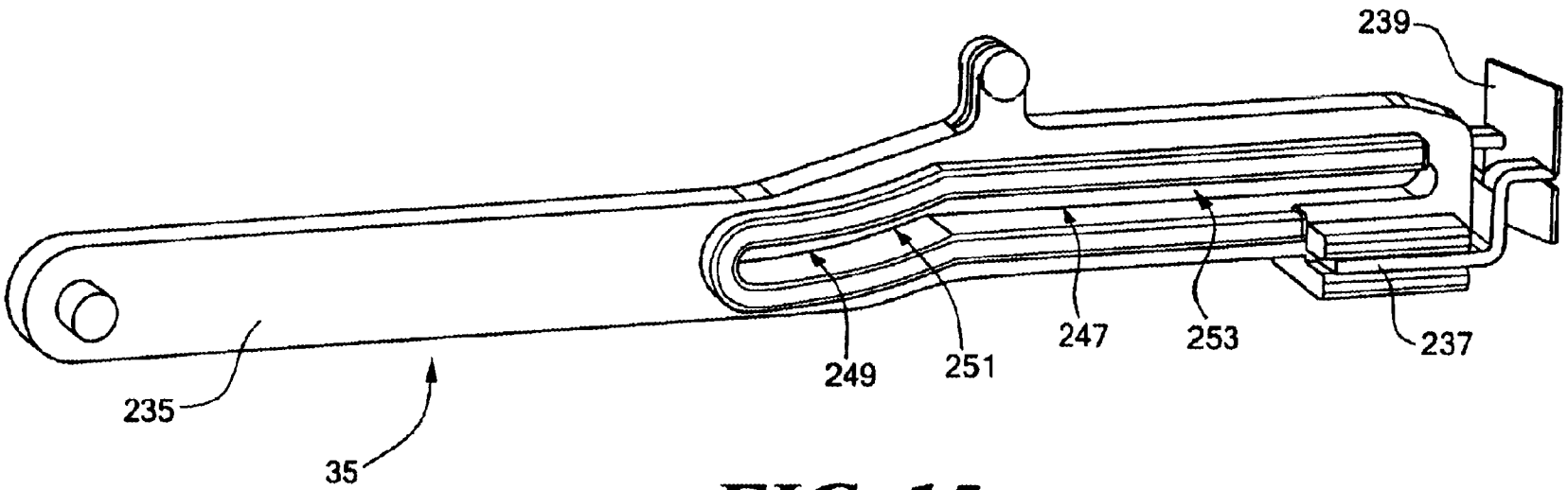
FIG. 15 is a perspective view of the severing mechanism for the device shown in FIG. 1.
Figure 16:
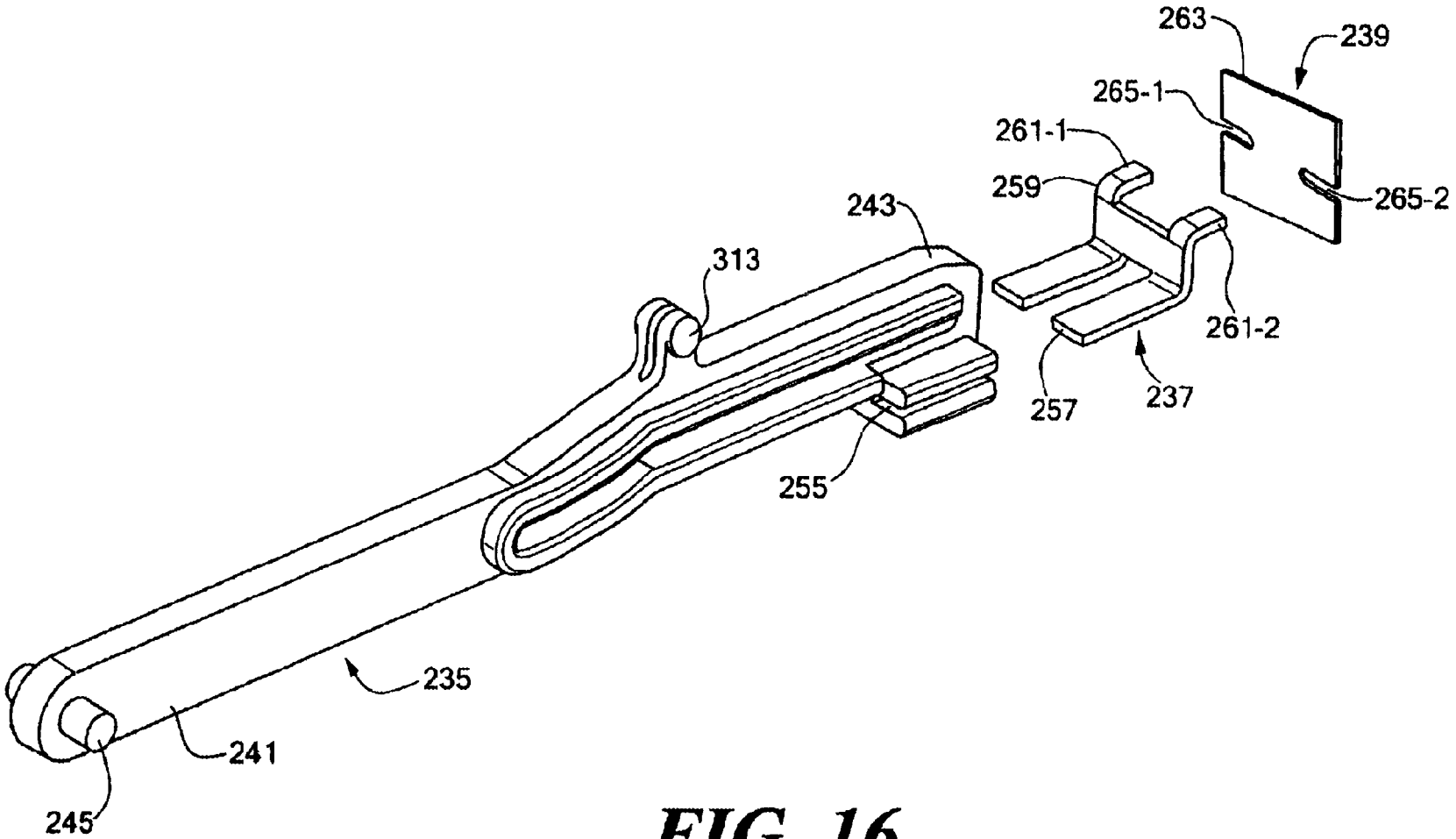
FIG. 16 is an exploded perspective view of the severing mechanism for the device shown in FIG. 1.

Referring now to FIGS. 15–16, severing mechanism 35 for device 11 serves to separate a desired plastic staple 13 from the remainder of the supply of ladder stock 15 prior to the ejection of said plastic staple by ejection mechanism 33. Severing mechanism 35 comprises an elongated cam, or lever, 235 which is pivotally disposed within housing 29, a knife lifter 237, or support, mounted onto cam 235, and a knife blade 239 which is mounted onto knife lifter 237.

Elongated cam 235 is disposed between the pair of spaced apart ejector slides 197 and includes a first end 241 and a second end 243. First end 241 of elongated cam 235 is shaped to include an integrally formed pivot post 245 which is sized and shaped to be fittingly disposed within a post receptacle 246 which is formed in each of left side piece 51 and right side piece 53. As such, elongated cam 235 is capable of pivotal movement about pivot post 245, the pivoting of elongated cam 235 serving to displace second end 243 along a substantially vertical plane, as will be discussed further below.

Elongated cam 235 is shaped to define an elongated slot 247 along its length. Slot 247 is sized and shaped to enable actuator pin 201 to extend laterally therethough, the width of slot 247 being slightly larger than the width of actuator pin 201. As such, lateral translation of ejection mechanism 33 causes actuator pin 201 to travel laterally within slot 247.

Slot 247 is non-linear in shape. Specifically, slot 247 is shaped to include a substantially horizontal rear portion 249, an angled middle portion 251 and a substantially horizontal forward portion 253. As can be appreciated, due to the non-linear shape of slot 247, as actuator pin 201 travels laterally forward within slot 247 from rear portion 249 to forward portion 253, actuator pin 201 urges against cam 235 in such as manner so as to pivot cam 235 in a clockwise direction, thereby drawing second end 243 of cam 235 down along a substantially vertical plane. Similarly, as actuator pin 201 travels laterally backward within slot 247 from forward portion 253 to rear portion 249, actuator pin 201 urges against cam 235 in such a manner so as to pivot cam 235 in a counterclockwise direction, thereby drawing second end 243 of cam 235 up along a substantially vertical plane.

Second end 243 of cam 235 is shaped to include a pair of grooves 255 which are formed into opposite sides of cam 235. As will be described further below, grooves 255 enable knife lifter 237 to be removably mounted onto second end 243 of cam 235.

Knife lifter 237 is constructed of a rigid and durable material and has a unitary, generally Z-shaped configuration in longitudinal cross-section. Knife lifter 237 includes a first end 257 and a second end 259. First end 257 is bifurcated and is sized and shaped to fittingly slide into grooves 255, the tight fit of first end 257 into grooves 255 serving to secure knife lifter 237 onto second end 259 of cam 235. Second end 259 of cam lifter 237 is shaped to include a pair of spaced apart prongs 261 which serve to support knife blade 239. It should be noted that second end 259 of cam lifter 237 extends horizontally along a plane disposed above the horizontal plane defined by first end 257.

Knife blade 239 is a conventional knife blade which includes a sharpened top edge 263 which is adapted to sever the desired plastic staple 13 from the remainder of ladder stock 15. Knife blade 239 is shaped to include a pair of spaced apart slots 265-1 and 265-2 which are sized and shaped to receive prongs 261-1 and 261-2, respectively, thereby enabling knife blade 239 to be removably mounted onto knife lifter 237.

Figure 17:
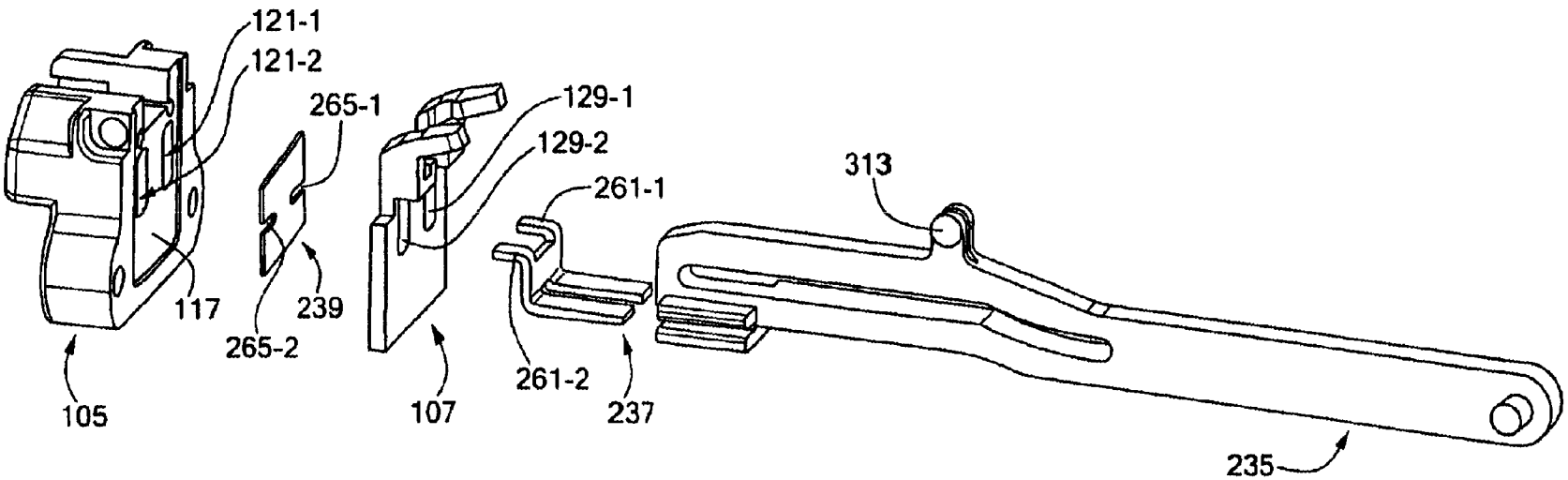
FIG. 17 is an exploded perspective view of the severing mechanism and the needle housing for the device shown in FIG. 1.

It should be noted that knife blade 239 is preferably disposed between needle housing 105 and support plate 107, as shown in FIG. 17. Specifically, knife blade 239 is preferably disposed within shallow channel 117 and is capable of vertical displacement therewithin. It should be noted that, since knife blade 239 is sandwiched between needle housing 105 and support plate 107, prongs 261-1 and 261-2 of cam lifter 237 are sized and shaped to project through slots 129-1 and 129-2, respectively, in support plate 107, through slots 265-1 and 265-2, respectively, in knife blade 239 and into grooves 121-1 and 121-2, respectively, formed in needle housing 105. Disposed in this manner, knife blade 239 can be replaced as desired by the operator by removing the screws which secure needle housing assembly 103 onto device 11 and separating needle housing 105 from support plate 107.

In use, severing mechanism 35 functions in the following manner. Specifically, with actuator pin 201 of ejection mechanism 33 disposed in is rearmost position, sharpened top edge 263 of knife blade 239 is disposed in its upwardmost position so as to sever the desired plastic staple 13 from the remainder of ladder stock 15 prior to ejection by ejection mechanism 33. Upon activation of trigger assembly 31 by the operator, actuator pin 201 advances laterally forward within slot 247 formed in cam 235. Due to the non-linear nature of slot 247, forward lateral advancement of actuator pin 201 pivots cam 235 in the clockwise direction which, in turn, downwardly displaces knife blade 239 along a substantially vertical plane. With knife blade 239 disposed in its downward position beneath the desired plastic staple 13, ejection mechanism 33 is able to perform the ejection process. Upon completion of the ejection process, trigger assembly 31 is released which, in turn, causes actuator pin 201 to travel laterally in the rearward direction within slot 247 of cam 235. As can be appreciated, due to the non-linear nature of slot 247, rearward lateral displacement of actuator pin 201 pivots cam 235 in the counterclockwise direction which, in turn, upwardly displaces knife blade 239 along a substantially vertical plane in such a manner that sharpened top edge 263 of knife blade 239 severs the next plastic staple 13 from the remainder of ladder stock 15.

Indexing Mechanism 37 for Device 11

Figure 18:
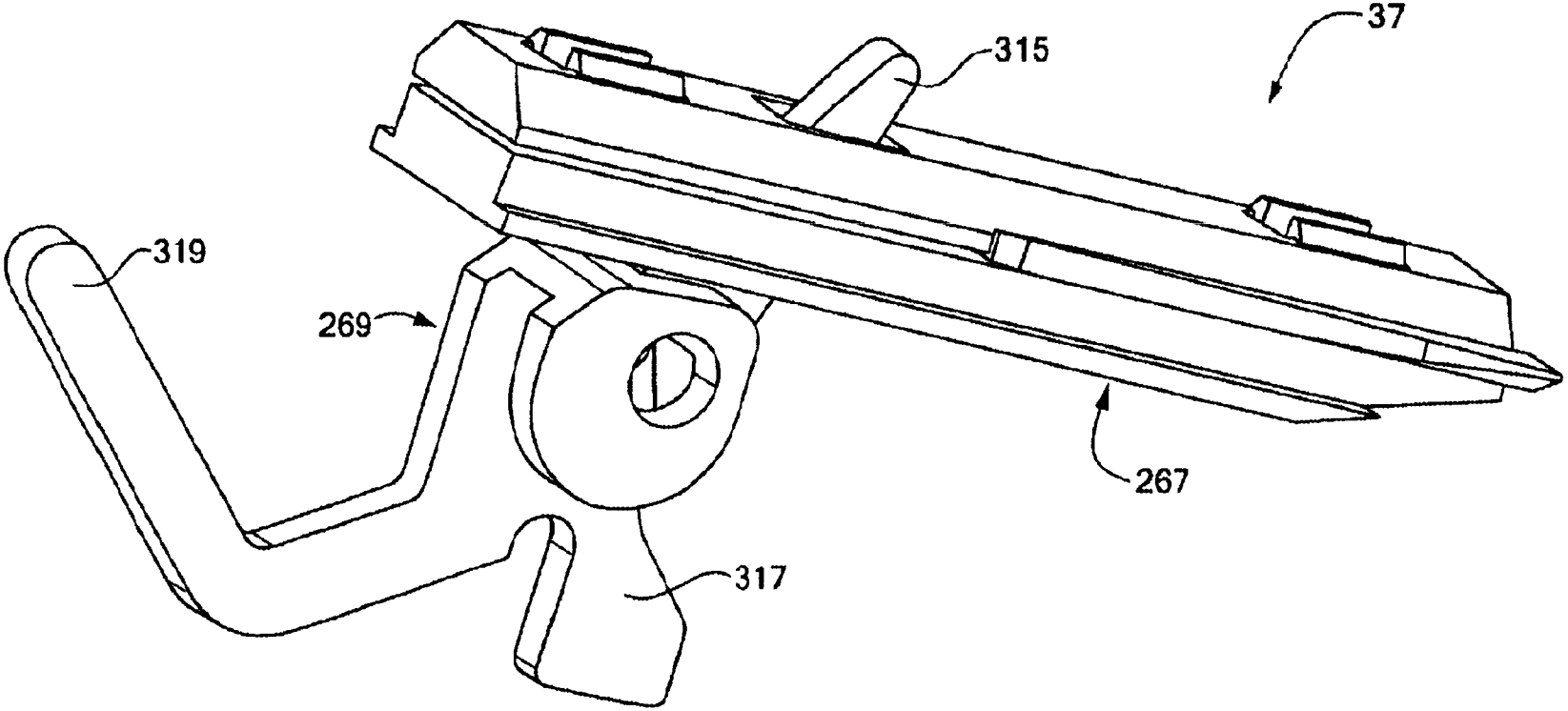
FIG. 18 is a perspective view of the indexing mechanism for the device shown in FIG. 1.
Figure 19:
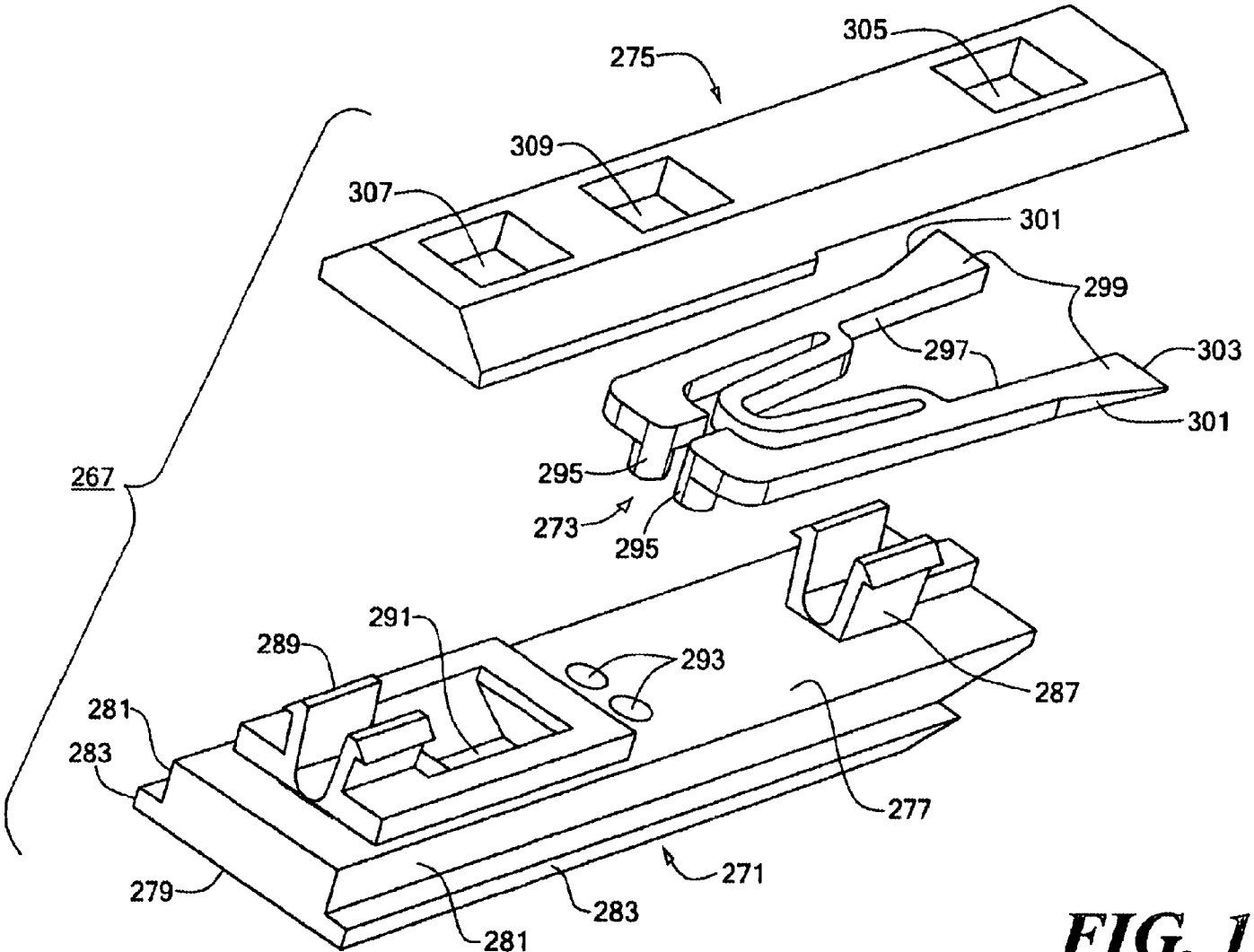
FIG. 19 is an exploded perspective view of the indexing mechanism for the device shown in FIG. 1.

Referring now to FIGS. 18–19, indexing mechanism 37 for device 11 serves to index a desired plastic staple 13 from ladder stock 15 in such a manner that cross-bars 23 and 25 of said staple 13 are in proper alignment with elongated bores 209 of hollowed needles 195. Indexing mechanism 37 comprises a feed slide 267 for indexing the desired plastic staple 13 into alignment for the subsequent severing and ejection processes and a feed dog 269 for controlling feed slide 267.

Feed slide 267 is slidably disposed within elongated slot 55 in top surface 45 of housing 29 and comprises a base 271, a feed member 273 disposed on base 271 and a cover 275 snap mounted onto base 271 so as to sandwich feed member 273 between base 271 and cover 275, as shown most clearly in FIG. 19.

Base 271 is an elongated unitary member which includes a top surface 277, a bottom surface 279 and a pair of sidewalls 281. Each sidewall 281 is shaped to include an outwardly extending guide projection 283. As can be appreciated, with feed slide 267 properly mounted onto housing 29, guide projections 283 are sized and shaped to fittingly project into associated guide channels 285 formed into left side piece 51 and right side piece 53 to limit the movement of feed slide 267 to within elongated slot 55 in top surface 45 of housing 29.

Top surface 277 of base is shaped to include a first pair of outwardly biased retention spring fingers 287 and a second pair of outwardly biased retention spring fingers 289 which together serve to retain cover 275 onto base 271. Base 271 is also shaped to define a substantially rectangular opening 291. Top surface 277 is further shaped to define a pair of spaced apart holes 293 into which feed member 273 is removably mounted, as will be described below.

Feed member 273 is one-piece and includes a pair of downwardly projecting posts 295 which are sized and shaped to project into holes 293 to retain feed member 273 in a mounted position on top surface 277 of base 271. Feed member 273 includes a pair of spaced apart, substantially parallel, inwardly compressible spring arms 297 which serve to selectively engage ladder stock 15 during the indexing process. Each spring arm 297 includes a finger 299 at its free end. Each finger 299 is shaped to include a tapered sidewall 301 and a flat engagement surface 303.

Cover 275 is a unitary member is shaped to define a pair of apertures 305 and 307 through which first and second outwardly biased retention spring fingers 287 and 289, respectively, can be disposed so as to releasably snap-mount cover 275 onto base 271. Cover 275 is also shaped to define a substantially rectangular opening 309 which is in alignment with opening 291 in base 271 when cover 275 is mounted onto base 271.

Feed dog 269 is pivotally mounted onto a vertically extending tab 313 formed onto cam 235 about a pivot pin and is disposed to selectively displace feed slide 267. As shown in FIG. 18, feed dog 269 is a unitary member which includes a first finger 315, a second finger 317 and a third finger 319. As can be appreciated, first finger 315 is sized and shaped to project through openings 291 and 309 in feed slide 267. In this manner, pivotal movement of feed dog 269, in turn, causes first finger 315 to selectively abut against and urge feed slide 267 in either the forward or rearward direction within elongated slot 55 in housing 29.

In use, indexing mechanism 37 functions in the following manner. Specifically, with actuator pin 201 of ejection mechanism 33 disposed in its rearmost position, first finger 315 of feed dog 269 is disposed so as urge feed slide 267 in its most forward position. With feed slide 267 disposed in its most forward position, fingers 299 of feed slide 267 are disposed behind filament 27 of the desired plastic staple 13, thereby urging staple 13 into proper alignment within needles 195 for the subsequent severing and ejection processes.

Upon activation of trigger assembly 31 by the operator, actuator pin 201 advances laterally forward within slot 247 formed in cam. As actuator pin 201 advances laterally forward, actuator pin 201 eventually contacts the rear surface of second finger 317. Continued forward advancement of actuator pin 201 causes actuator pin 201 to pivot feed dog 269 in the counterclockwise direction which, in turn, causes first finger 315 to rearwardly displace feed slide 267. As feed slide 267 is rearwardly displaced, tapered sidewalls 301 of fingers 299 abut against the next filament 27 in ladder stock 15. As feed slide 267 continues in the rearward direction, the force of the next filament 27 onto tapered sidewalls 301 of fingers 299 causes spring arms 297 to inwardly compress until flat engagement surface 303 of each finger 299 is disposed behind the next filament 27, at which time, spring arms 297 resiliently outwardly expand back to their original position. Feed slide 267 remains in this position during the completion of the ejection process.

Upon completion of the ejection process, trigger assembly 31 is released which, in turn, causes actuator pin 201 to travel laterally in the rearward direction within slot 247 of cam 235. Actuator pin 201 travels laterally rearward until actuator pin 201 contacts the front surface of third finger 319. Continued rearward displacement of actuator pin 201 causes actuator pin 201 to pivot feed dog 269 in the clockwise direction which, in turn, causes first finger 315 to displace feed slide 267 forward. As feed slide 267 is displaced forward, flat engagement surface 303 of each finger 299 of feed slide 267 abuts against next filament 27 in ladder stock 15 and advances ladder stock 15 forward until next plastic staple 13 is disposed into proper alignment with needles 195 for the next round of the severing and ejection processes.

Operation of System 10

In use, device 11 can be used to dispense a plastic staple 13 from a supply of ladder stock 11 to affix together two or more products in the following manner. With the products positioned as desired and with supply of ladder stock 15 properly loaded into device 11, the operator grasps handle and manipulates device 11 in such a manner so that needles 195 penetrate through the products.

Figure 20A:
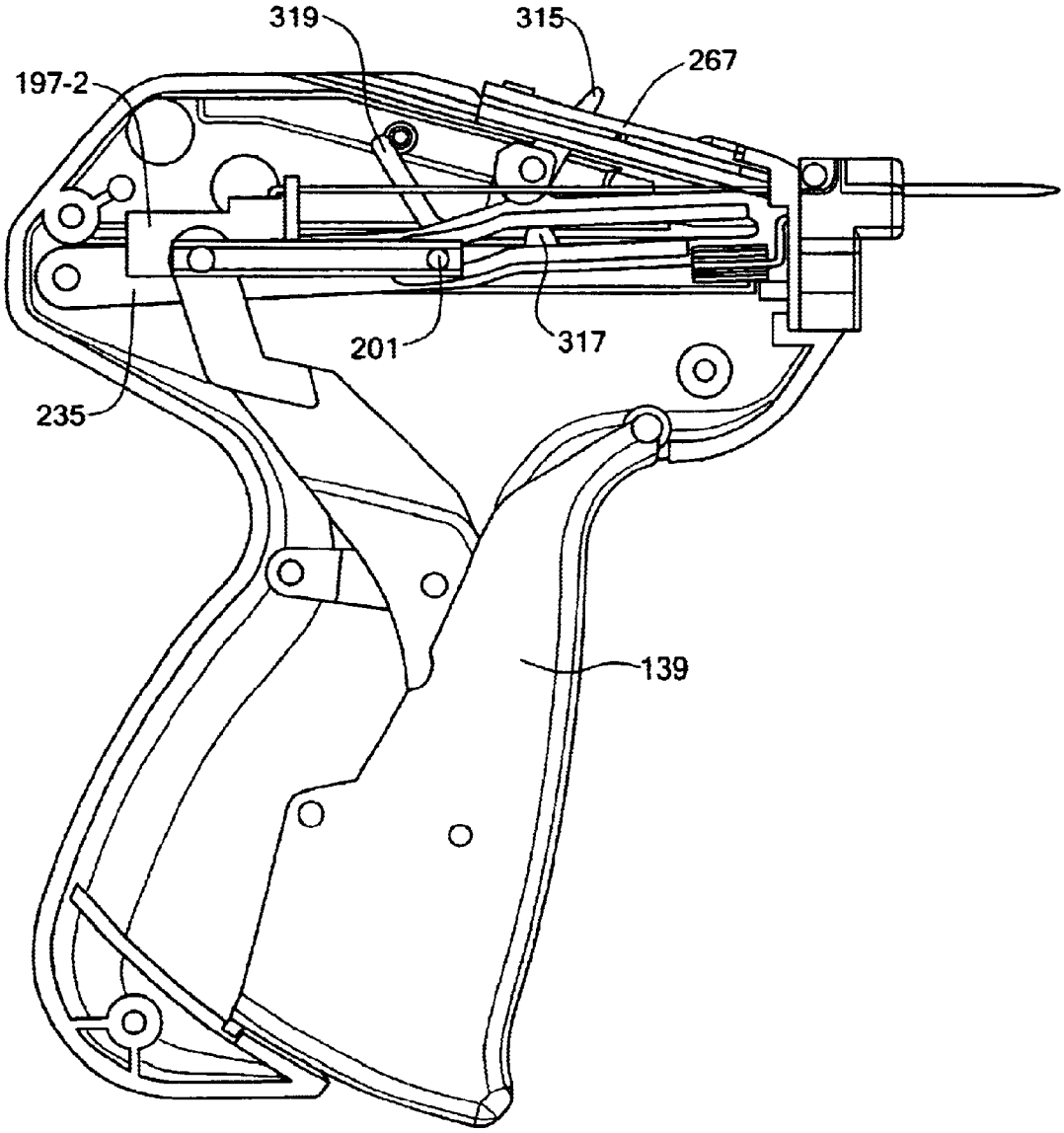
FIGS. 20(*a*)–(*c*) are right side plan views of the device shown in FIG. 1 at various stages during the process for dispensing an individual plastic fastener from a supply of fastener stock, the device being shown with the right side piece of the housing and selected components of the trigger assembly removed.
Figure 20B:
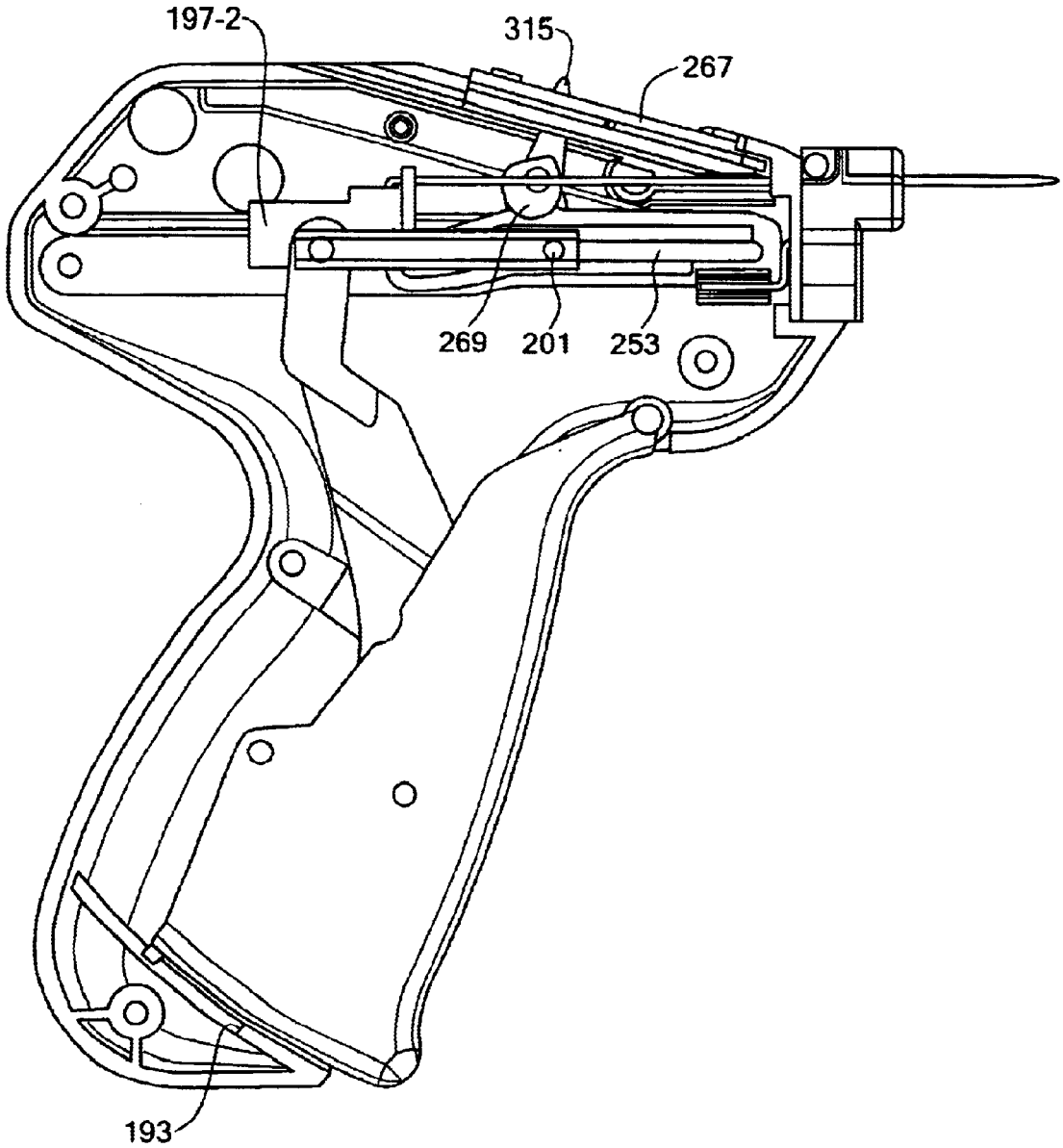
Figure 20C:
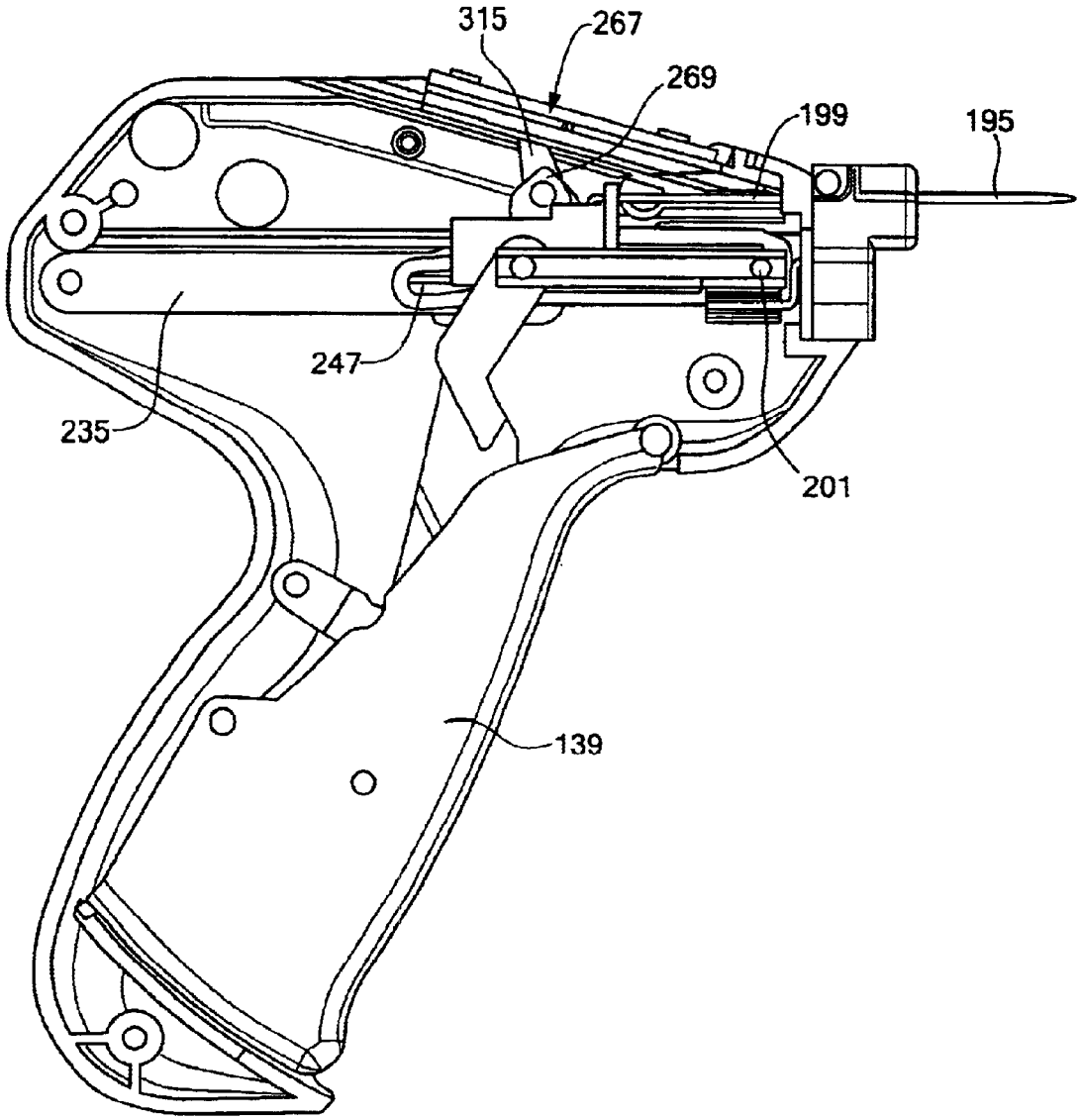
Figure 21A:
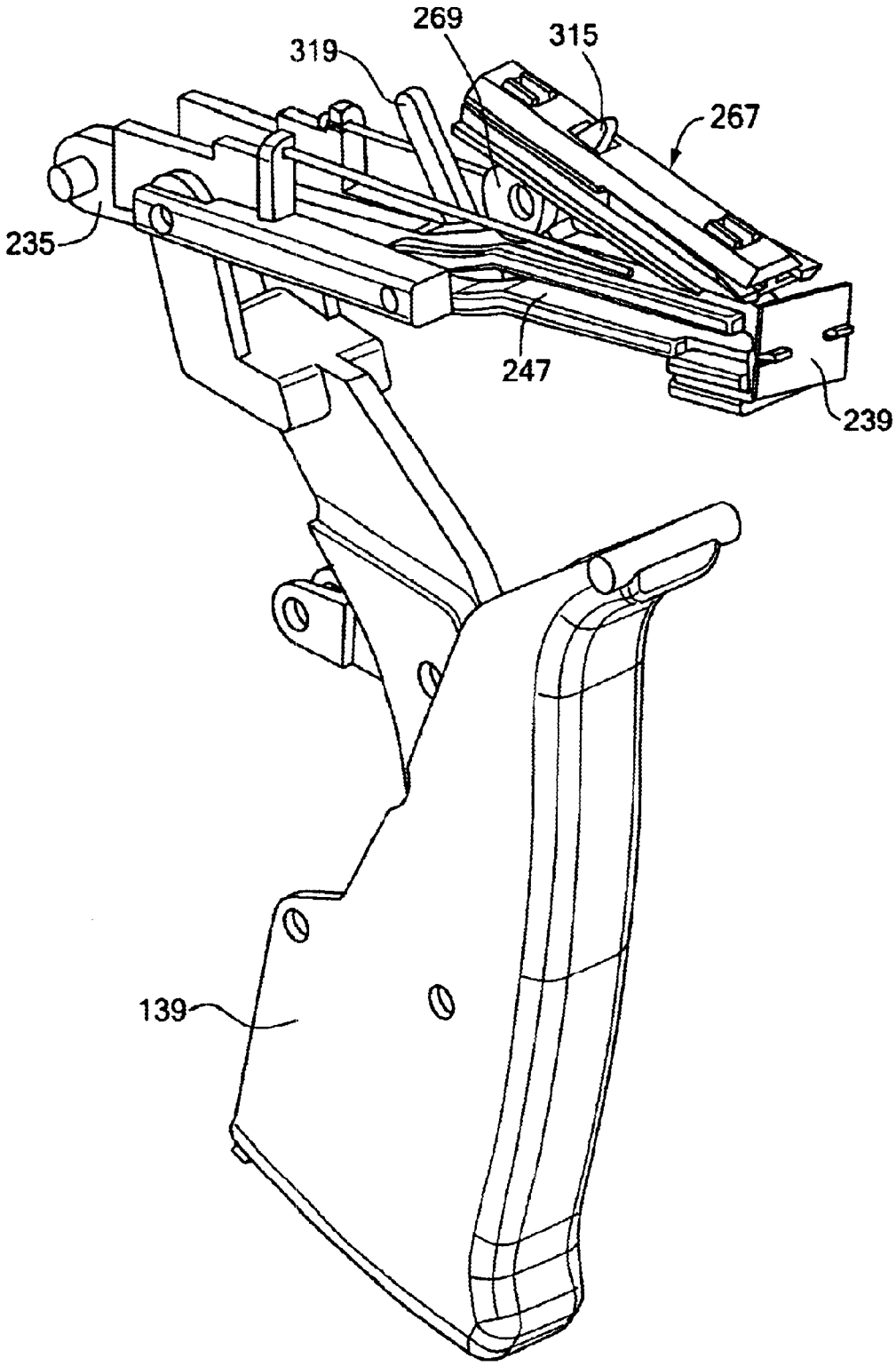
FIGS. 21 (*a*)–(*c*) are right side perspective views of the device shown in FIG. 1 at various stages during the process for dispensing an individual plastic fastener from a supply of fastener stock, the device being shown with the housing and selected components of the trigger assembly removed.
Figure 21B:
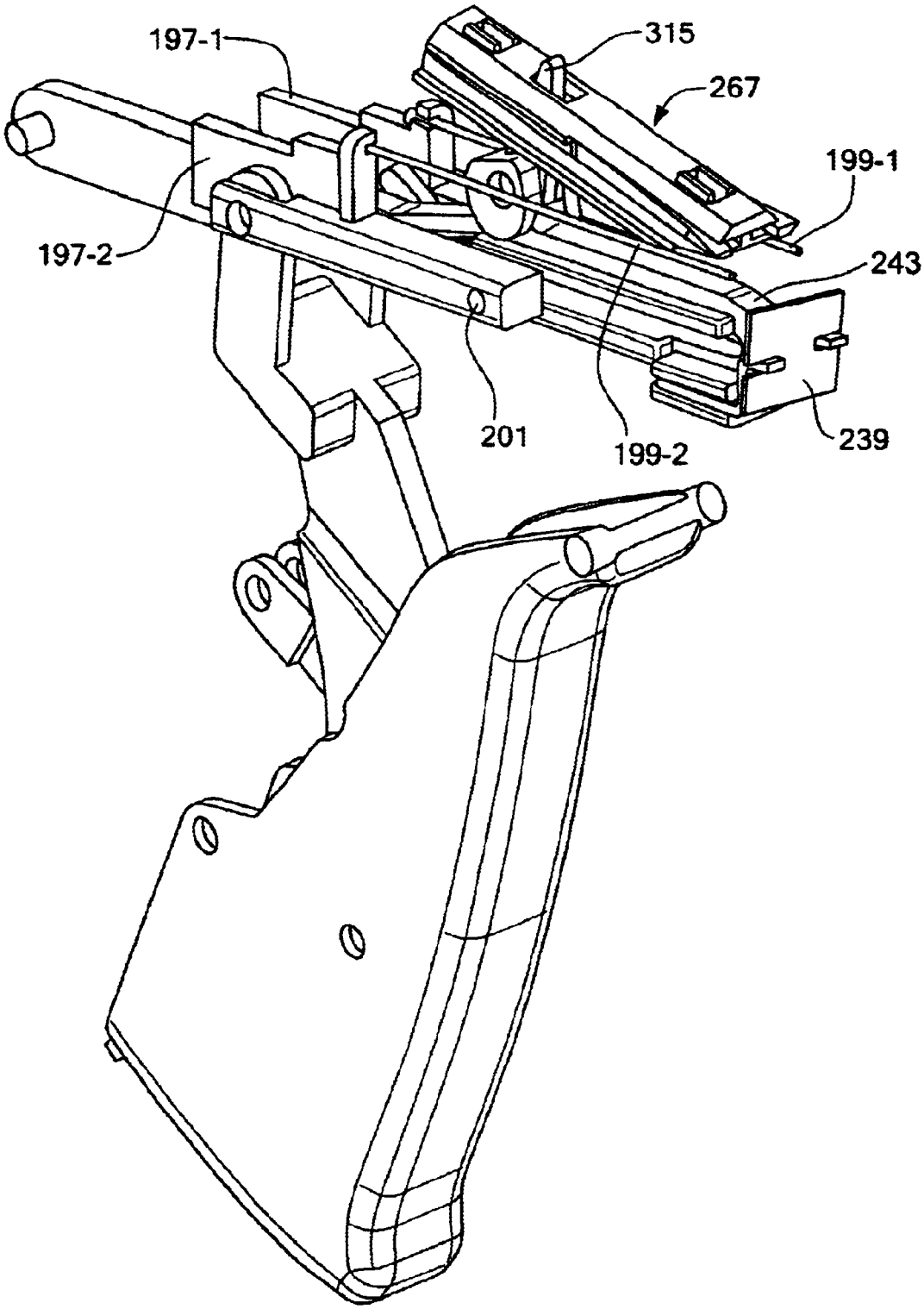
Figure 21C:
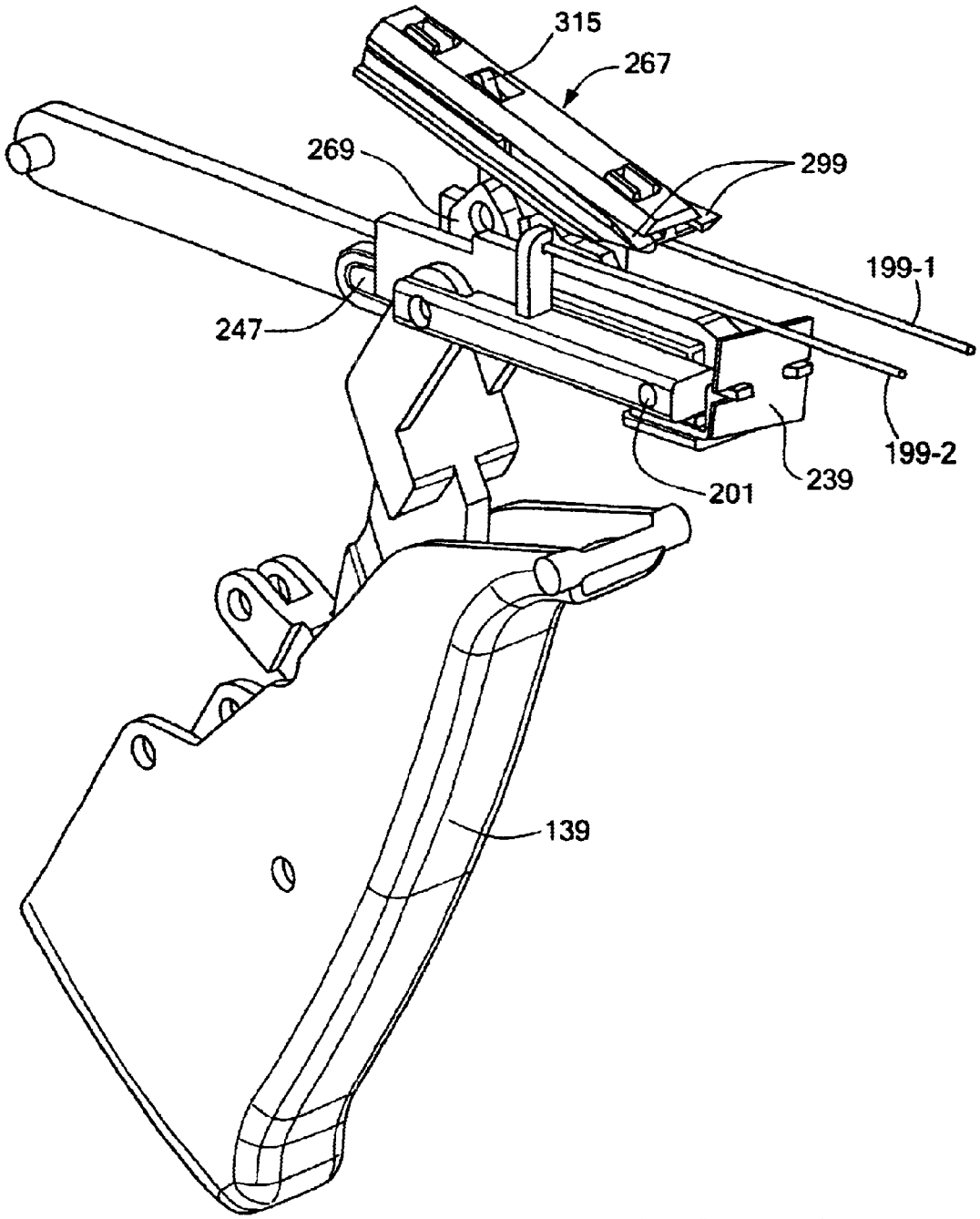

Referring now FIGS. 20(*a*)–(*c*) and FIGS. 21(*a*)–(*c*), the forward stroke of device 11 commences upon the activation of trigger 139. Specifically, trigger 139 is inwardly compressed which, in turn, laterally advances actuator pin 201 in the forward direction within slot 247 formed in cam 235. As actuator pin 201 advances from rear portion 249 of slot 247 and into middle portion 251, actuator pivot begins to pivot second end 243 of cam 235 in the clockwise direction which, in turn, downwardly displaces knife blade 239 along a substantially vertical plane.

Continued forward advancement of actuator pin 201 into front portion 253 of slot 247 serves to pivot second end 243 of cam 235 in the clockwise direction until knife blade 239 is disposed to its lowermost position, as shown in FIG. 20(*b*) and FIG. 21(*b*). Disposed in its lowermost position, knife blade 239 is positioned beneath ejector rods 195 so that ejection mechanism 33 can dispense the desired plastic staple 13.

Continued forward advancement of actuator pin 201 within front portion 253 of slot 247 serves to activate indexing mechanism 37. Specifically, actuator pin 201 rotates feed dog 269 in the clockwise direction which, in turn, rearwardly displaces fingers 299 of feed slide 267 behind the next filament 27 in ladder stock 15.

Completion of the forward advancement of actuator pin 201 along the front horizontal portion 253 of slot 247, as shown in FIG. 20(*c*) and FIG. 21 (*c*), serves to complete the ejection process. Specifically, ejector rods 199 advance cross-bars 23 and 25 of the desired plastic staple 13 out through needles 195, thereby dispensing the staple 13 through the desired objects to be coupled together.

Upon completion of the ejection process, trigger assembly 31 is released which, in turn, causes actuator pin 201 to travel laterally in the rearward direction within slot 247 of cam 235. As actuator pin 201 begins to travel laterally in the rearward direction, ejector rods 195 withdraw, or retract, from within needles 195.

As actuator pin 201 continues to travel laterally in the rearward direction, actuator pin 201 eventually contacts third finger 319 of feed dog 269. Actuator pin 201 continues rearward and rotates feed dog 269 in the clockwise direction which, in turn, drives feed slide 267 forward. The forward displacement of feed slide 267 indexes the next plastic staple 13 in ladder stock 15 into position behind pair of needles 195.

As actuator pin 201 continues to travel laterally in the rearward direction, actuator pin 201 eventually travels into angled middle portion 251 of slot 247. Due to the non-linear nature of slot 247, actuator pin 201 pivots cam 235 about post 245 in the counterclockwise direction which, in turn, upwardly displaces knife blade 239 along a substantially vertical plane. The upward displacement of knife blade 239 draws sharpened top edge 263 of knife blade 239 against side rails 19 and 21 in such a manner so as to sever the next plastic staple 13 from the remainder of ladder stock 15.

Upon full release of trigger 139, actuator pin 201 returns to its initial position, as shown in FIG. 20(*a*) and FIG. 21(*a*). The process for dispensing an individual plastic staple 13 from supply of ladder stock 15 can be repeated as desired.

The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A device for dispensing an individual plastic fastener from a supply of fastener stock to couple together two or more objects, the individual plastic fastener comprising a flexible filament and a transversely disposed cross-bar at one end, said device comprising:

(a) a housing, (b) an ejection mechanism for dispensing the individual plastic fastener, (c) a severing mechanism for separating the individual plastic fastener from the remainder of the supply of fastener stock, and (d) an indexing mechanism for advancing the supply of fastener stock into said housing, said indexing mechanism comprising, (i) a feed slide slidably disposed within said housing, said feed slide comprising a base slidably disposed within said housing and a feed member mounted on said base, said feed member comprising an inwardly pivotable spring arm, said spring arm including a finger which is sized and shaped to engage and advance the supply of fastener stock, said finger extending laterally outward, and (ii) a pivotally mounted feed dog for displacing said feed slide.

2. A device for dispensing an individual plastic fastener from a supply of fastener stock to couple together two or more objects, the individual plastic fastener comprising a flexible filament and a transversely disposed cross-bar at one end, said device comprising:

(a) a housing, (b) an ejection mechanism for dispensing the individual plastic fastener, (c) a severing mechanism for separating the individual plastic fastener from the remainder of the supply of fastener stock, and (d) an indexing mechanism for advancing the supply of fastener stock into said housing, said indexing mechanism comprising, (i) a feed slide slidably disposed within said housing, said feed slide comprising a feed member, said feed member comprising an inwardly pivotable spring arm and a post about which said spring arm is capable of pivoting said spring arm including a finger which is sized and shaped to engage and advance the supply of fastener stock, said finger extending laterally outward, and (ii) a pivotally mounted feed dog for displacing said feed slide.

3. A device for dispensing an individual plastic fastener from a supply of fastener stock to couple together two or more objects, the individual plastic fastener comprising a flexible filament and a transversely disposed cross-bar at one end, said device comprising:

(a) a housing, (b) an ejection mechanism for dispensing the individual plastic fastener, (c) a severing mechanism for separating the individual plastic fastener from the remainder of the supply of fastener stock, and (d) an indexing mechanism for advancing the supply of fastener stock into said housing, said indexing mechanism comprising, (i) a feed slide slidably disposed within said housing, said feed slide comprising an inwardly pivotable spring arm, said spring arm including a finger which is sized and shaped to engage and advance the supply of fastener stock, said finger extending laterally outward and including a tapered sidewall and a flat engagement surface, and (ii) a pivotally mounted feed dog for displacing said feed slide.

4. The device as claimed in claim 1 wherein said feed slide further comprises a cover mounted onto said base, said feed member being disposed between said cover and said base.

5. The device as claimed in claim 4 wherein said housing is shaped to define a feed slide guide channel.

6. The device as claimed in claim 5 wherein the base of said feed slide includes a projection which is sized and shaped to partially project into the feed slide guide channel in said housing.

7. The device as claimed in claim 6 wherein said feed slide is limited to linear displacement within the feed guide channel.

* * * * *